US009982406B2

(12) United States Patent
Bradley, Sr. et al.

(10) Patent No.: US 9,982,406 B2
(45) Date of Patent: May 29, 2018

(54) GEOTEXTILE TUBES WITH POROUS INTERNAL SHELVES FOR INHIBITING SHEAR OF SOLID FILL MATERIAL

(75) Inventors: Anthony Shepherd Bradley, Sr., Valparaiso, FL (US); Anthony Shepherd Bradley, Jr., Valparaiso, FL (US)

(73) Assignee: BRADLEY INDUSTRIAL TEXTILES, INC., Valparaiso, FL (US)

( * ) Notice: Subject to any disclaimer, the term of this patent is extended or adjusted under 35 U.S.C. 154(b) by 562 days.

(21) Appl. No.: 13/507,539

(22) Filed: Jul. 6, 2012

(65) Prior Publication Data

US 2014/0010601 A1 Jan. 9, 2014

(51) Int. Cl.

| | |
|---|---|
| ***E02B 3/10*** | (2006.01) |
| ***E02B 3/06*** | (2006.01) |
| ***E02B 3/12*** | (2006.01) |

(52) U.S. Cl.

CPC ..... *E02B 3/06* (2013.01); *E02B 3/108* (2013.01); *E02B 3/127* (2013.01)

(58) Field of Classification Search

USPC .... 405/15, 17, 19, 21, 107, 111, 115, 302.4, 405/302.6, 302.7, 16

See application file for complete search history.

(56) References Cited

U.S. PATENT DOCUMENTS 752,781 A * 2/1904 Kerr ..... E02B 3/04 405/15
1,905,176 A * 4/1933 Kieckhefer ..... E01C 13/083 405/15
2,092,183 A * 9/1937 Rehfeld ..... E02B 3/124 405/19
2,616,096 A * 11/1952 Hasselquist ..... E04H 4/0025 4/506
3,561,219 A * 2/1971 Nishizawa ..... D03D 25/00 405/19
3,837,169 A * 9/1974 Lamberton ..... E02B 3/127 405/18
3,886,751 A * 6/1975 Porraz Jimenez Labora ..... B28B 7/065 383/32
4,154,061 A * 5/1979 Umemoto ..... E02B 3/127 139/384 R (Continued)

FOREIGN PATENT DOCUMENTS

EP 1512795 A1 * 3/2005
FR 2883309 9/2006

(Continued)

OTHER PUBLICATIONS

International Search Report and Written Opinion, dated Mar. 14, 2013.

(Continued)

*Primary Examiner* — Benjamin F Fiorello
*Assistant Examiner* — Edwin J Toledo-Duran
(74) *Attorney, Agent, or Firm* — Dority & Manning, P.A.

(57) ABSTRACT

A large scale geotextile tube includes a plurality of shelves that extend across the width of the geotextile tube with each shelf formed of a web of geogrid material or geocell material. As one moves from the bottom of the geotextile tube to the top of the geotextile tube, the width of each shelf decreases. The geotextile tube can be surrounded by an envelope formed of geogrid material.

27 Claims, 16 Drawing Sheets

(56) References Cited

U.S. PATENT DOCUMENTS 4,184,788 A * 1/1980 Colle ..... E02B 3/127 405/18
4,299,514 A * 11/1981 Muramatsu ..... E04B 7/005 405/107
4,367,978 A * 1/1983 Schaaf ..... E02B 3/04 405/21
4,449,847 A * 5/1984 Scales ..... E02B 3/127 405/17
4,502,815 A * 3/1985 Scales ..... E02B 3/127 139/384 R
4,555,201 A * 11/1985 Paoluccio ..... E02B 3/108 405/117
4,610,568 A * 9/1986 Koerner ..... E02D 17/202 405/15
4,661,014 A * 4/1987 Aubert ..... E02B 3/04 405/111
4,717,283 A * 1/1988 Bach ..... E01C 3/00 404/17
4,729,691 A * 3/1988 Sample ..... E02B 3/127 405/15
4,770,564 A * 9/1988 Dison ..... E04B 1/0007 405/272
4,778,309 A * 10/1988 Bach ..... E02D 29/02 405/284
4,787,774 A * 11/1988 Grove ..... E02B 7/005 405/101
4,797,026 A * 1/1989 Webster ..... E01C 3/06 404/28
4,804,293 A * 2/1989 Varkonyi ..... E02B 3/126 405/15
4,906,134 A * 3/1990 Hoyeck ..... E02B 7/005 405/107
4,965,097 A * 10/1990 Bach ..... E02D 17/20 405/16
4,966,491 A * 10/1990 Sample ..... E02B 3/04 405/15
5,059,065 A * 10/1991 Doolaege ..... E02B 3/127 405/107
5,091,247 A * 2/1992 Willibey ..... D03D 15/00 139/420 A
5,125,767 A 6/1992 Dooleage
5,156,495 A * 10/1992 Mercer ..... B29D 28/00 405/262
5,158,395 A * 10/1992 Holmberg ..... E02B 3/127 405/15
5,505,557 A 4/1996 Bradley
5,857,806 A * 1/1999 Melin ..... E02B 3/108 405/114
5,865,564 A * 2/1999 Miller ..... E02B 3/108 405/114
5,902,070 A 5/1999 Bradley
5,951,202 A * 9/1999 Brown ..... E02B 3/04 405/19
6,022,172 A * 2/2000 Siyaj ..... E02B 3/108 405/110
6,056,438 A * 5/2000 Bradley ..... E02B 3/04 112/475.08
6,126,362 A * 10/2000 Carter ..... E02B 3/108 405/114
6,186,701 B1 * 2/2001 Kempers ..... E02B 3/127 383/105
6,312,192 B1 * 11/2001 Dery ..... E02B 3/108 405/107
6,334,736 B1 * 1/2002 Johnson ..... E02B 3/108 405/107
6,364,571 B1 * 4/2002 Doolaege ..... E01D 15/20 405/114
6,395,372 B1 * 5/2002 Bach ..... E02D 17/202 405/15
6,481,928 B1 * 11/2002 Doolaege ..... E01D 15/20 138/98
6,551,025 B2 * 4/2003 Dery ..... E02B 3/108 405/115
6,641,329 B1 * 11/2003 Clement ..... E02B 3/108 405/115
6,672,799 B2 * 1/2004 Earl ..... E02B 3/04 404/6
6,783,300 B2 * 8/2004 Doolaege ..... E02B 3/108 405/115
7,097,390 B1 * 8/2006 Moss ..... E02B 3/127 405/262
7,165,912 B2 * 1/2007 Herzog ..... E02B 3/04 249/10
7,281,882 B2 * 10/2007 Hilfiker ..... E02D 29/0241 405/262
7,314,336 B2 * 1/2008 Moss ..... E02B 3/127 405/262
7,357,598 B1 * 4/2008 Bradley ..... E02B 3/108 405/111
7,591,611 B2 * 9/2009 Arellanes ..... E02B 3/108 405/111
8,226,325 B1 * 7/2012 Pierce, Jr. ..... E02B 3/06 405/15
2004/0047688 A1 * 3/2004 Clement ..... E02B 3/108 405/115
2004/0071510 A1 * 4/2004 Dery ..... E02B 3/108 405/115
2006/0099033 A1 * 5/2006 Boraggina ..... E02B 3/108 405/107
2006/0147275 A1 * 7/2006 Lin ..... E02D 17/20 405/302.4
2006/0280563 A1 * 12/2006 Glick ..... B29C 73/025 405/302.7
2007/0036615 A1 * 2/2007 Kim ..... 405/284
2007/0269275 A1 * 11/2007 Kimberlin ..... E02D 17/20 405/302.6
2008/0193229 A1 * 8/2008 Graham et al. ..... 405/302.7
2009/0129866 A1 * 5/2009 Smallwood ..... E02B 3/127 405/16
2009/0142144 A1 * 6/2009 Erez et al. ..... 405/284
2009/0142542 A1 * 6/2009 Halahmi ..... E02D 17/20 428/116
2009/0208288 A1 * 8/2009 Stephens ..... E02B 3/127 405/45
2010/0003081 A1 1/2010 Doolaege
2012/0257926 A1 * 10/2012 De Giuseppe ..... B29D 28/00 404/76

FOREIGN PATENT DOCUMENTS

WO WO 96/27710 9/1996
WO WO 00/14384 3/2000
WO WO 2006/094552 9/2006

OTHER PUBLICATIONS

International Preliminary Report on Patentability for PCT/us201/053865, dated Jan. 15, 2015.

* cited by examiner

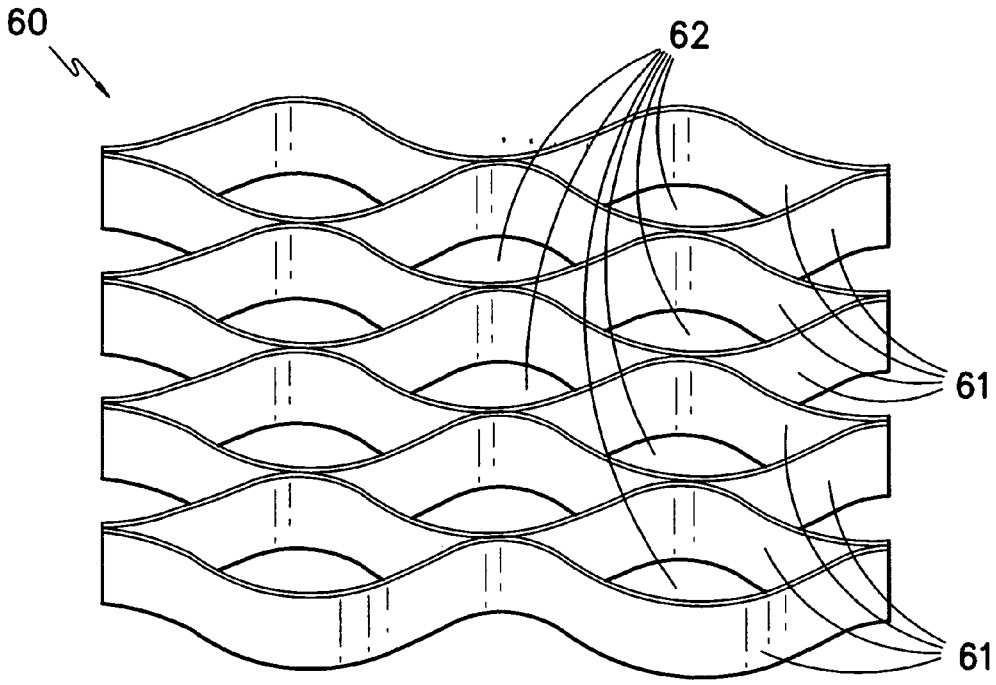
FIG. –9–
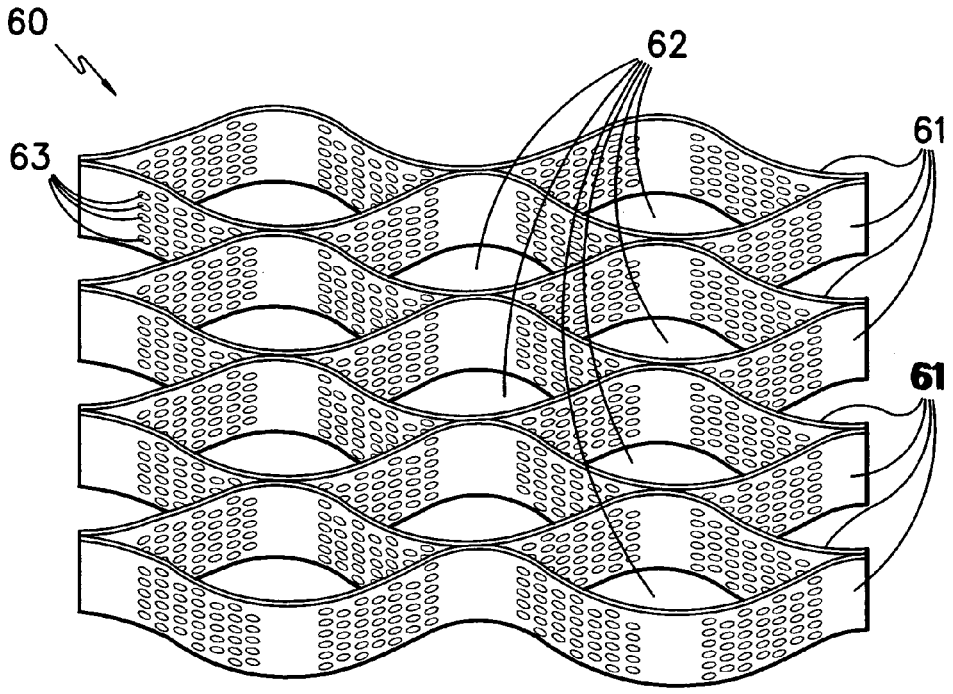
FIG. –10–

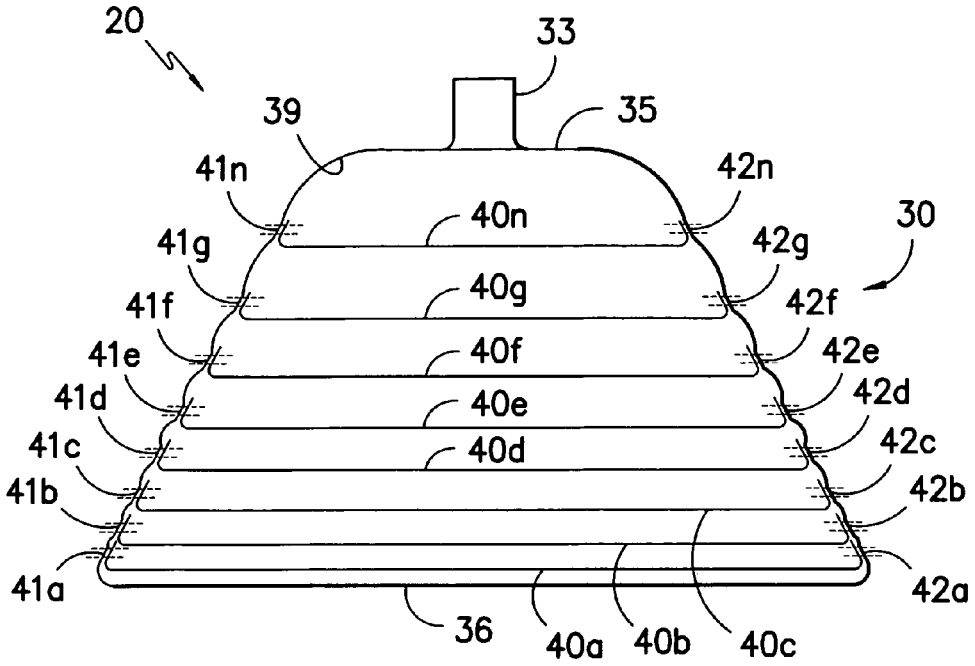
FIG. –14–
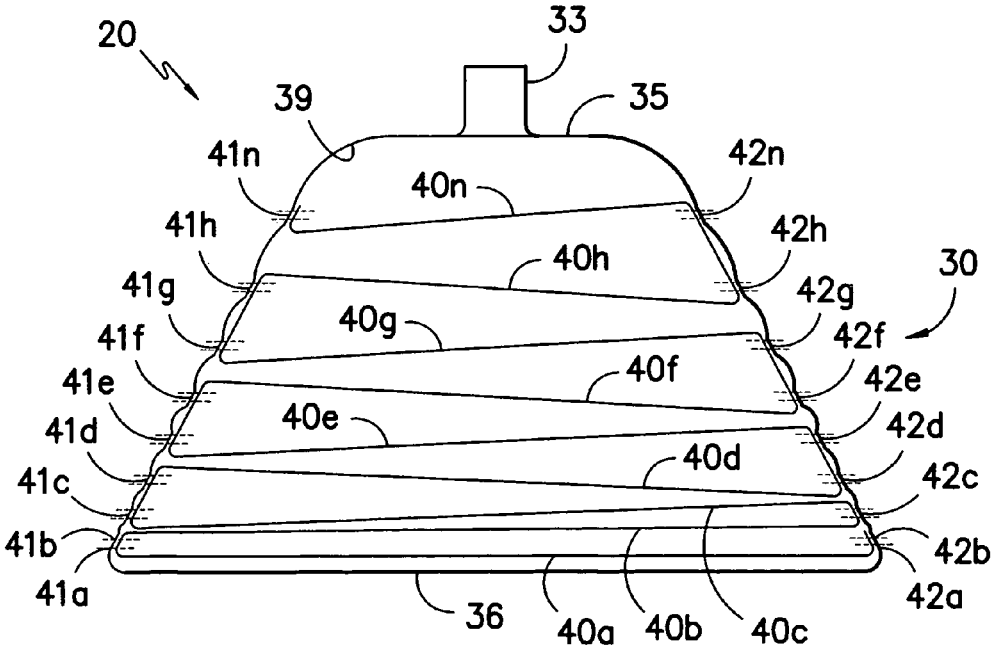
FIG. –15–

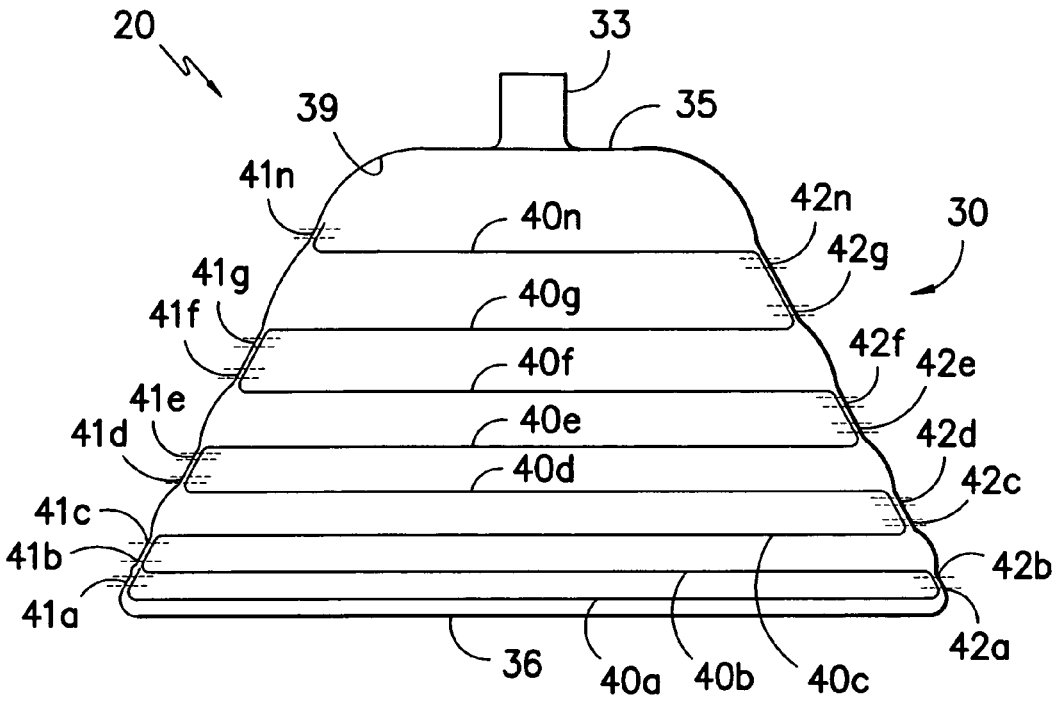
FIG. –16–

GEOTEXTILE TUBES WITH POROUS INTERNAL SHELVES FOR INHIBITING SHEAR OF SOLID FILL MATERIAL

CROSS REFERENCE TO RELATED APPLICATIONS

N/A

FIELD OF THE INVENTION

The subject matter disclosed herein generally involves geotextile tubes and in particular those that are large scale.

BACKGROUND OF THE INVENTION

As described in U.S. Pat. No. 6,186,701 to Kempers for example, which is hereby incorporated herein for all purposes by this reference, geotextile tubes are elongate flexible containers made of textile fabric and have been used as the core or base of a dam, a quay, a bank reinforcement, at the bed of a waterway, etc. and for dewatering sludge and other purposes.

Many dredged soils cannot be used where load bearing is required. Indeed, a conventional type geotube cannot reach any significant elevation when attempts are made to fill the geotube with silts, clays and organic matter. Designs for causeways have used geotubes stacked on the outside to act as the slopes protecting the roadways that are filled with dredged material. However, the soils constituting the dredged material that can fill the geotubes must be selected from soils capable of providing stability to those slopes, and this requirement often disqualifies some materials in close proximity to the location from being dredged to fill the geotubes.

Because of the natural tendency of the settling of the many tons of materials in slurry form that are pumped under pressure into geotextile tubes during their deployments alongside shorelines and other areas for which erosion protection is desired, the height of such geotextile tubes when filled with solids becomes limited by the circumference of the geotextile tube and the nature of the solids, all other parameters being equal. Moreover, geotextile tubes filed to their maximum natural height or close to that height tend to be relatively unstable and therefore pose safety issues if the solids might shift due to some environmental influence for example. Furthermore, instead of having a uniform transverse shape, when such conventional geotextile tubes are filled with solids that have been pumped into them, they also often are misshapen and resemble the form of undulating snakes with transverse shapes that vary all along the lengths of the geotextile tubes.

Increasing the maximum height at which large scale geotextile tubes of a given circumference and filled with solids of a given nature remain stable has been a vexing problem, the solution of which potentially capable of yielding many advantages.

The use of geotubes for filtering large amounts of liquid-solid matter has placed focus on the filtering characteristics of the fabrics used to construct the geotubes. For example, the fabric used to dewater coal sludge will have different filtering characteristics than the fabric used to de-water human waste. Moreover, the use of geotubes for de-watering sludge and filtering all types of waste, including food processing, animal and human etc., has created a demand for larger and stronger geotubes. To meet this demand, the strength of the fabrics used to make the geotubes has been increased. This increase in fabric strength has been attained by increasing the volume and density of the yarns per unit of length of the fabric and by using bulkier yarns. However, the attainment of increased strength in this manner results in undesirable changes in the filtering characteristics of the fabric.

BRIEF DESCRIPTION OF THE INVENTION

Aspects and advantages of the invention are set forth below in the following description, or may be obvious from the description, or may be learned through practice of embodiments of the invention.

One embodiment of the invention includes an axially elongated geotextile tube (a.k.a. geotube). At least one inlet opening and at least one outlet opening are formed through the top of the geotube, and extending through each such opening is a respective inlet conduit and outlet conduit. The bottom of the geotube is disposed opposite the top of the geotube and is intended to rest on the surface that underlies and supports the geotube when the geotube is deployed for its intended use.

The embodiment of the invention further includes a plurality of porous shelves that is disposed inside the geotube, and each such porous internal shelf extends axially down the length of the geotube. Each shelf desirably is defined by a web of material that consists of open void over more than half the area of the web and desirably up to 95% of the area of the web. The opposite sides edges of each shelf are connected to respective opposed sidewalls of the geotube. The porous internal shelves are disposed above the bottom of the geotube and disposed one above the other. The shelves vary in width, with the widest shelf disposed closest to the bottom of the geotube and the narrowest shelf disposed farthest from the bottom of the geotube. With the shelves disposed inside the geotube so that the width of each successive shelf gradually decreasing as one proceeds from the bottom of the geotube to the top of the geotube, the shelves impose a generally triangular transverse shape to the envelope of geotextile material that defines the geotube. The shelves desirably are disposed parallel to each other. The shelves desirably can be formed of geogrid material, and the areas of the grid openings defined by the solid portions of the geogrid material can vary. In one embodiment, the areas of the grid openings defined by the geogrid material are uniform in magnitude. In another embodiment, the areas of the grid openings defined by the solid portions of the geogrid material forming the shelves located closer to the bottom of the geotube are smaller than the areas of the grid openings defined by the geogrid material forming the shelves located farther from the bottom of the geotube. In a further embodiment the density of shelves is greater nearer to the bottom of the geotube than the density of shelves nearer to the top of the geotube.

In embodiments in which the geotube is formed by axially extending segments that are connected end-to-end to form the complete length of the geotube, the axial length of each shelf can be limited to the axial length of the geotube segment in which the shelf is disposed.

In an alternative embodiment of the invention, the shelves are formed by one continuous sheet of web material that snakes its way from near the bottom to near the top of the geotextile tube.

In another alternative embodiment of the invention, the shelves desirably are disposed so that no two adjacent shelves are parallel to each other.

In a further embodiment, the shelves desirably can be formed of geocell material, and the areas of the cell openings that are defined by the solid portions of the geocell material can vary. In one embodiment, the areas of the cell openings defined by the solid portions of the geocell material forming the shelves located closer to the bottom of the geotube are smaller than the areas of the cell openings defined by the geocell material forming the shelves located farther from the bottom of the geotube. In another embodiment, the areas of the cell openings defined by the geocell material forming each shelf are uniform in magnitude.

In an alternative embodiment of the invention, at least one end of the geotube defines a sloping profile. Each shelf terminates axially in this sloping profile end of the geotube according to the relative order of its distance measured from the bottom of the geotube. Thus, the shelf farthest from the bottom of the geotube terminates axially before each of the other shelves terminates axially, and the shelf closest to the bottom of the geotube terminates axially after each of the other shelves terminates axially.

Another embodiment of the invention includes an axially elongated geotextile tube that is wrapped within an envelope of geogrid material.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which:

FIG. 9 is an elevated perspective view of an embodiment of a component of a geotextile tube in accordance with the invention.

FIG. 10 is an elevated perspective view of another embodiment of a component of a geotextile tube in accordance with the invention.

FIG. 14 is a cross-sectional view similar to the view taken along the lines of 3-3 in FIG. 1, but of an alternative embodiment of the geotextile apparatus.

FIG. 15 is a cross-sectional view similar to the view of FIG. 14 but of an alternative embodiment of the geotextile apparatus.

FIG. 16 is a cross-sectional view similar to the view of FIG. 14 but of another alternative embodiment of the geotextile apparatus.

DETAILED DESCRIPTION OF THE INVENTION

Figure 1:
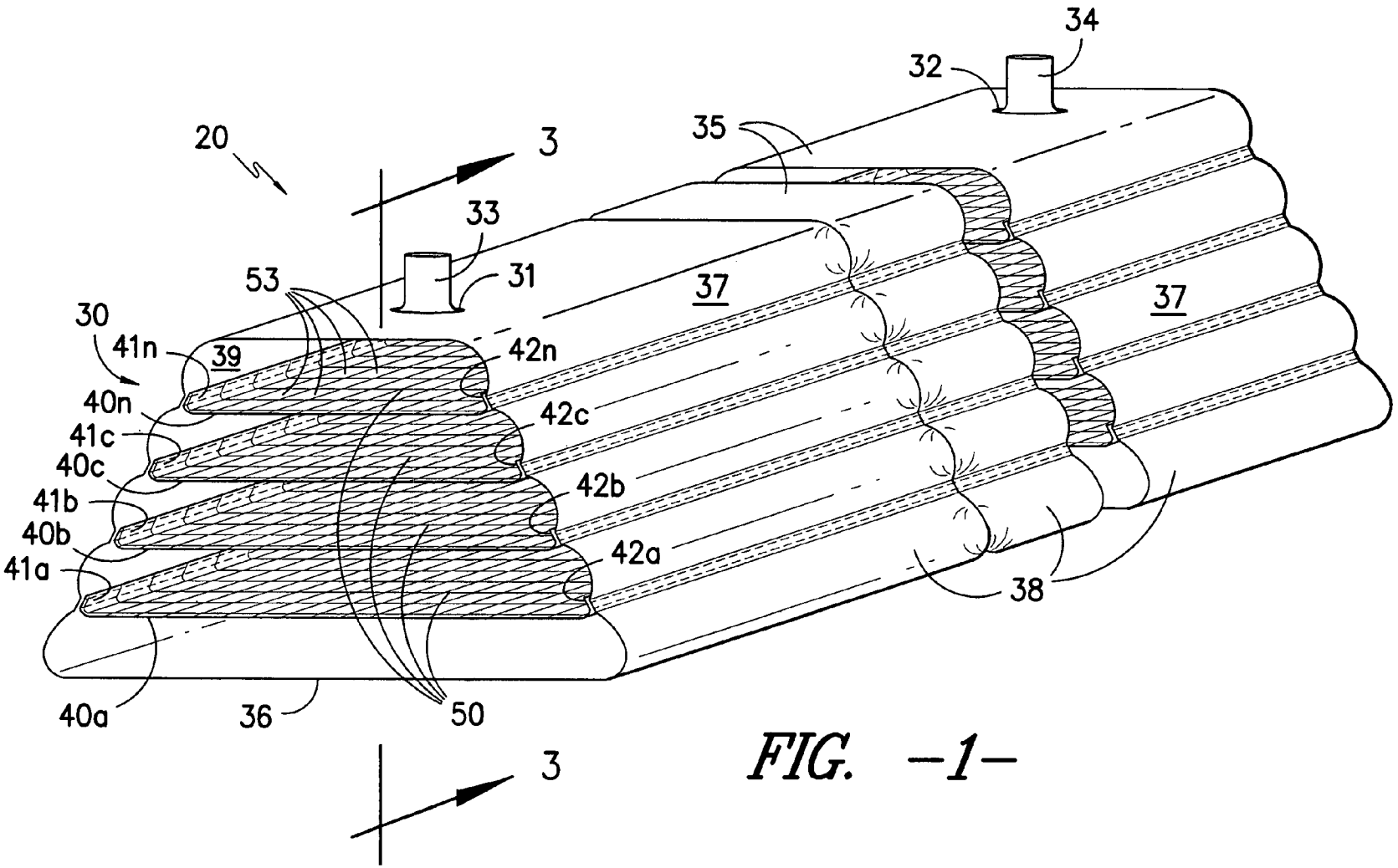
FIG. 1 is an elevated perspective view of an embodiment of a geotextile tube in accordance with the invention with an open end and a middle section cut away for purposes of illustration of certain aspects of the geotextile tube.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

It is to be understood that the ranges and limits mentioned herein include all sub-ranges located within the prescribed limits, inclusive of the limits themselves unless otherwise stated. For instance, a range from 100 to 200 also includes all possible sub-ranges, examples of which are from 100 to 150, 170 to 190, 153 to 162, 145.3 to 149.6, and 187 to 200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7.

One embodiment of the geotextile apparatus of the present invention is depicted in FIG. 1 and indicated generally by the numeral 20. The geotextile apparatus 20 desirably includes an axially elongated geotextile tube 30 (a.k.a. geotube 30), which is formed of geotextile fabric 37. The geotextile material 37 forming the geotextile tube 30 desirably can be formed by being woven from synthetic fibers such as nylon, polypropylene, polyester, polyethylene or any combination of the foregoing fibers. Among the most widely used materials are polyesters laminated or coated with polyvinyl chloride (PVC), and woven fiberglass coated with polytetrafluoroethylene (PTFE). Other materials would include geosynthetics, which can be woven, non-woven, geo-composites, grids, scrims, non-woven fabrics that are needled punched into woven fabrics or into grids, and the fabrics can be coated to impart desired properties, uncoated, water permeable, non-permeable to water or have a combination of permeable and non-permeable regions.

The axially elongated tube 30 is a large scale tube and thus desirably has a circumference of at least six meters. The axially elongated geotextile tube 30 defines an interior surface 39 that defines a hollow interior of the tube 30. The fabric forming the geotextile tube 30 will vary with the intended use. Typically, the fibers and threads that extend in the circumferential direction of the geotextile tube 30 tend to be stronger than the fibers or threads that extend in the axial direction of the geotextile tube 30. However, for any given intended end use, the internal structure (described below) of the geotextile apparatus 20 of the present invention allows one to employ a geotextile tube 30 formed of geotextile fabric with fibers and threads that extend in the circumferential direction that are not as strong as would be required if a conventional geotextile tube were to be employed in the intended end use. The reduction in strength can manifest itself in the use of threads that are made of material that has less tensile strength or by having fewer threads per unit of circumferential length of the geotextile tube 30 or both.

Being formed of tubular constructions of geotextile fabric, geotextile tubes 30 ordinarily have no rigidly defined shape until their interiors are filled with material. When geotextile tubes 30 are deployed in the field, they sometimes can be pre-filled initially with air or water to blow them up like balloons. Then in the filling process incompressible matter like solids or slurries of various materials in the immediate environment of the geotextile tubes 30, depending on the application, are pumped into the geotextile tubes 30 to fill them and expel the pre-fill of air or water. Once the interior of the geotextile tube 30 begins to be filled with incompressible matter, the exterior of the geotextile tube 30 begins to assume a shape, which varies depending on the fill material, the external environment of the geotextile tube 30, and the construction and materials defining the geotextile tube 30. For purposes that facilitate explanations of the embodiments of the geotextile tubes 30 described herein, it is assumed that the geotextile tubes 30 are filled with material, air or water for instance, in FIGS. 1, 1A, 1B, 2, 2A, 2B, 3-5 and 11-16.

Figure 1A:
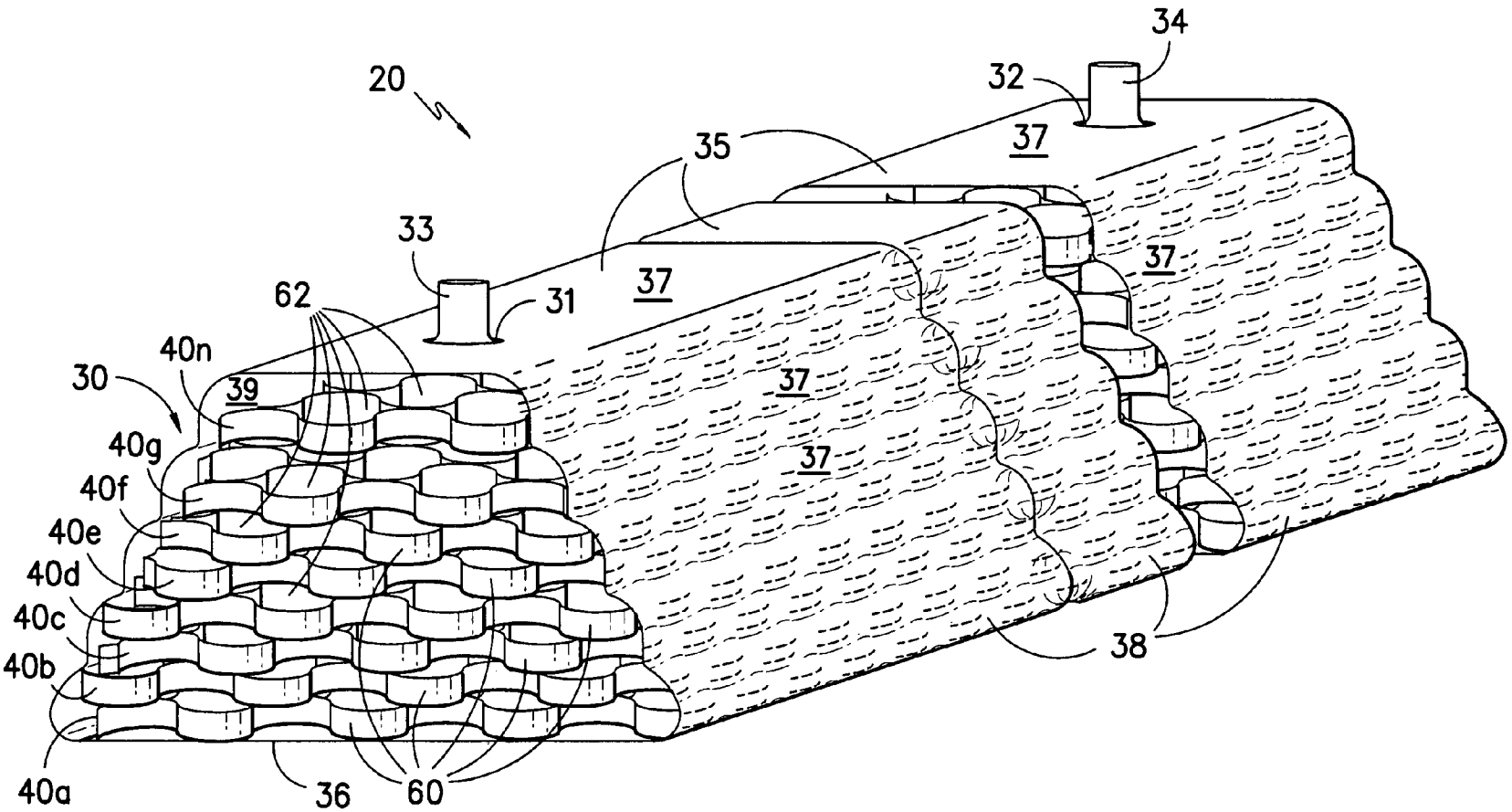
FIG. 1A is an elevated perspective view of another embodiment of a geotextile tube in accordance with the invention with an open end and a middle section cut away for purposes of illustration of certain aspects of the geotextile tube.
Figure 1B:
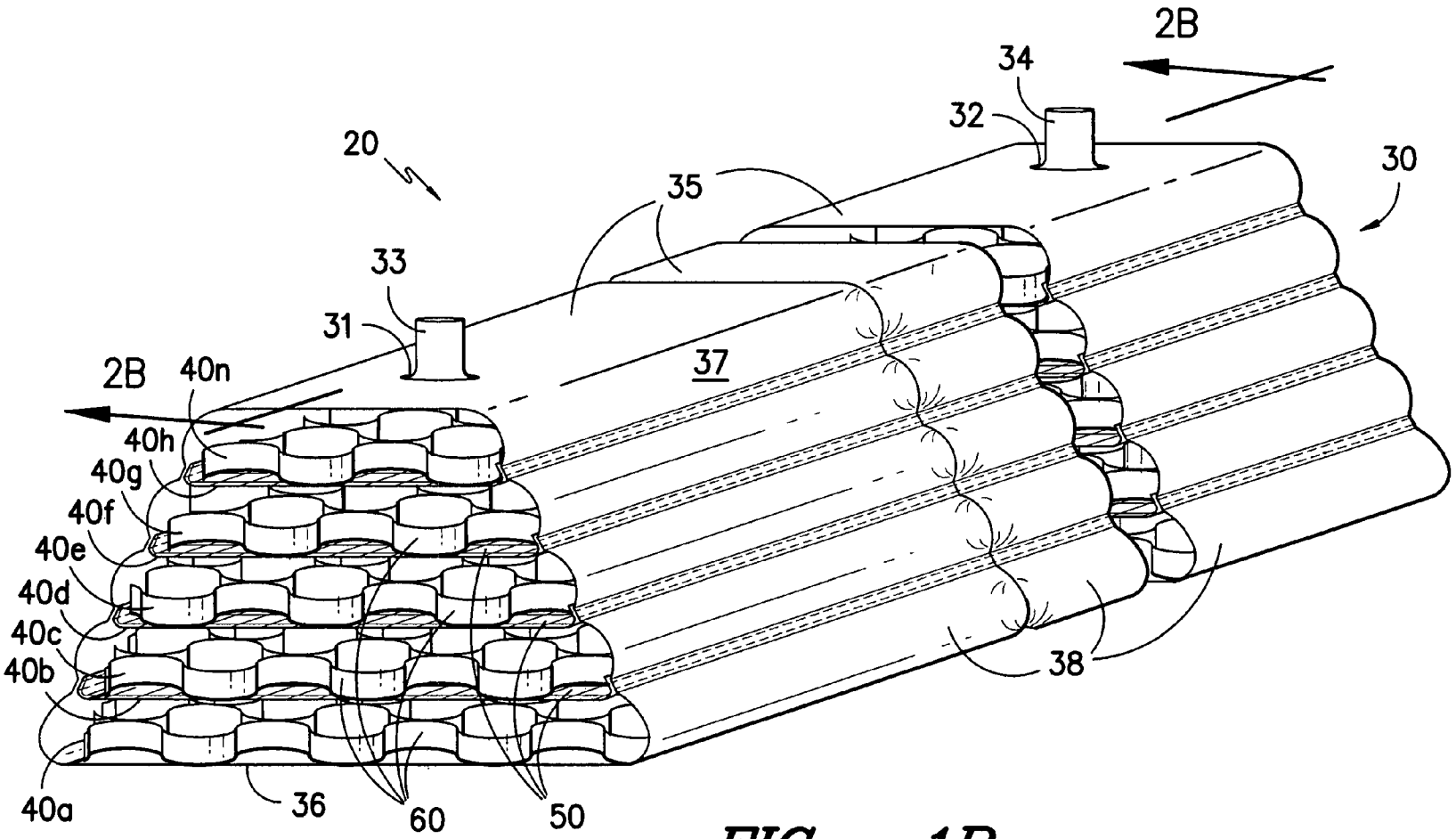
FIG. 1B is an elevated perspective view of another embodiment of a geotextile tube in accordance with the invention with an open end and a middle section cut away for purposes of illustration of certain aspects of the geotextile tube.

When the geotextile apparatus 20 is deployed for its intended use, the geotextile tube 30 rests on a supporting surface that varies depending on the application and environment. The portion of the geotextile tube 30 resting on the supporting surface is at the gravitational bottom of the geotextile tube 30 because that is where the incompressible fill material tends to be accumulate and remain under the influence of gravity. Thus, it further is assumed that the bottom 36 of the geotube 30 is that portion of the geotube 30 that rests on the surface that underlies and supports the geotube 30 when the geotube 30 is deployed for its intended use. As shown in FIGS. 1, 1A, 1B for example, the top 35 of the geotube 30 is disposed opposite the bottom 36 of the geotube 30.

The axially elongated tube 30 of geotextile material that forms part of the geotextile apparatus 20 of the present invention can be provided by any conventional geotextile tube. As shown in FIGS. 1, 1A and 1B for example, at least one inlet opening 31 and at least one outlet opening 32 are formed through the top 35 of the geotube 30, and extending through each such opening 31, 32 is a respective inlet conduit 33 and outlet conduit 34. Each of the inlet conduits 33 and outlet conduits 34 is a hollow pipe that can be connected to hoses (not shown) through which air and/or incompressible materials can be pumped into the geotextile tube 30 and/or expelled from the geotextile tube 30.

The geotextile apparatus 20 further comprises a plurality of porous shelves 40, which are disposed within the hollow interior of the geotube 30. As shown in FIGS. 1, 1A and 1B for example, the geotextile apparatus 20 further comprises a first generally planar shelf 40*a* that is porous and disposed within the interior of the geotextile tube 30 and has a length extending axially down the length of the geotextile tube 30. The first shelf 40*a* defines a first elongated side edge 41*a* connected to the interior surface 39 of the geotextile tube 30. Similarly, the first shelf 40*a* also defines a second elongated side edge 42*a* disposed opposite the first side edge 41*a* and connected to the interior surface 39 of the geotextile tube 30. The distance between the first side edge 41*a* and the second side edge 42*a* defines the width of the first shelf 40*a* extending transversely across the interior of the geotextile tube 30.

Similarly, as shown in FIGS. 1, 1A and 1B for example, the geotextile apparatus 20 desirably further comprises a second generally planar shelf 40*b* that is porous and disposed within the interior of the geotextile tube 30 and has a length extending axially down the length of the geotextile tube 30. The second shelf 40*b* similarly defines a first elongated side edge 41*b* connected to the interior surface 39 of the geotextile tube 30 and a second elongated side edge 42*b* disposed opposite the first side edge 41*b* and connected to the interior surface 39 of the geotextile tube 30. The distance between the first and second side edges 41*b*, 42*b* defines the width of the second shelf 40*b* extending transversely across the interior of the geotextile tube 30.

Moreover, as used herein, the designating numeral 40*n* will indicate the shelf 40 that is closest to the top 35 of the geotextile tube 30 and thus is the last shelf to be counted when starting the count from the bottom 36 of the geotextile tube 30 and proceeding to the top 35. Thus, as used herein, the nth designation always refers to the uppermost shelf 40 that is closest to the top 35 of the geotextile tube 30 and is indicated by the designating numeral 40*n* and can stand for the fourth shelf, the fifth shelf, the tenth shelf or the twentieth shelf, so long as the nth shelf 40*n* is the shelf 40 that is disposed closest to the top 35 of the geotextile tube 30. Accordingly, as shown in FIGS. 1, 1A, 1B, 2 and 2A for example, an nth generally planar shelf 40*n* is porous and disposed within the interior of the geotextile tube 30 and has a length extending axially down the length of the geotextile tube 30. As schematically shown in FIGS. 3-5 and 14-16 for example, the nth shelf 40*n* defines a first elongated side edge 41 n connected to the interior surface 39 of the geotextile tube 30 and a second elongated side edge 42*n* disposed opposite the first side edge 41*n* and connected to the interior surface 39 of the tube 30. As schematically shown in FIGS. 3-5 and 14-16 for example, the distance between the first and second side edges 41*n*, 42*n* defines the width of the nth shelf 40*n* extending transversely across the interior of the geotextile tube 30.

As shown in FIGS. 1, 1A and 1B for example, the opposite sides edges 41*a*, 42*a*, 41*b*, 42*b*, 41*c*, 42*c*, 41*n*, 42*n*, of each respective shelf 40*a*, 40*b*, 40*c*, 40*n* are connected to respective opposed sidewalls of the geotube 30. The dashed lines in FIGS. 1, 1A, 1B, 2A, 3-5 and 14-16 schematically represent the connections between the side edges of the shelves 40 and the geotextile tube 30. The porous shelves 40*a*, 40*b*, 40*c*, 40*n* are disposed above the bottom 36 of the geotube 30 and disposed one above the other. The shelves 40*a*, 40*b*, 40*c*, 40*n* vary in width, with the widest shelf 40*a* disposed closest to the bottom 36 of the geotube 30, and the narrowest shelf 40*n* disposed farthest from the bottom 36 of the geotube 30. Thus, the width of each successive shelf desirably decreases from the first shelf 40*a* to the nth shelf 40*n*. As shown in FIGS. 1, 1A, 1B, 2A, 3-5 and 14-16 for example, the shelves 40*a*, 40*b*, 40*c*, 40*n* desirably are disposed in the interior of the geotube 30 so that the width of each successive shelf 40*a*, 40*b*, 40*c*, 40*n* gradually decreases as one proceeds from the bottom 36 of the geotube 30 to the top 35 of the geotube 30. As shown in FIGS. 1, 1A, 1B, 2A, 3-5 and 14-16 for example, the width of the first shelf 40*a* is larger than the width of the second shelf 40*b*, and the width of the nth shelf 40*n* is smaller than the width of the second shelf 40*b*. As shown in FIGS. 1, 1A, 1B, 2A, 3-5 and 14-16 for example, the cumulative effect of the shelves 40*a*, 40*b*, 40*c*, 40*n* taken together desirably is to impose a generally trapezoidal transverse shape to the envelope of geotextile material 37 that defines the geotube 30.

Though only four porous shelves 40*a*, 40*b*, 40*c*, 40*n* are shown in FIG. 1 for example, a different number of porous shelves 40 can be used depending on the size and intended purpose for the geotextile apparatus 20. Eight porous shelves 40*a*, 40*b*, 40*c*, 40*d*, 40*e*, 40*f*, 40*g*, 40*n* are depicted in the embodiments of FIGS. 1A, 14 and 16 for example. Nine porous shelves 40*a*, 40*b*, 40*c*, 40*d*, 40*e*, 40*f*, 40*g*, 40*h*, 40*n* are depicted in the embodiments of FIGS. 1B and 15 for example.

As shown in FIGS. 1, 1A, 1B, 2A, 3-5 and 14-16 for example, there typically will be some vertical distance and space between the nth porous shelf 40*n* and the top 35 of the geotextile tube 30. As shown in FIG. 1, some embodiments will leave a vertical distance and space between the bottom 36 of the geotextile tube 30 and the first porous shelf 40*a*. However, as shown in FIGS. 1A and 1B, other embodiments will have the first shelf 40*a* rest on the bottom 36 of the geotextile tube 30. As shown in FIGS. 14-16 for example, in some embodiments there will be a relatively smaller vertical distance and space between the first shelf 40*a* and the bottom 36 of the geotextile tube 30 than the vertical distance and space between the nth shelf 40*n* and the top 35 of the geotextile tube 30.

Figure 3:
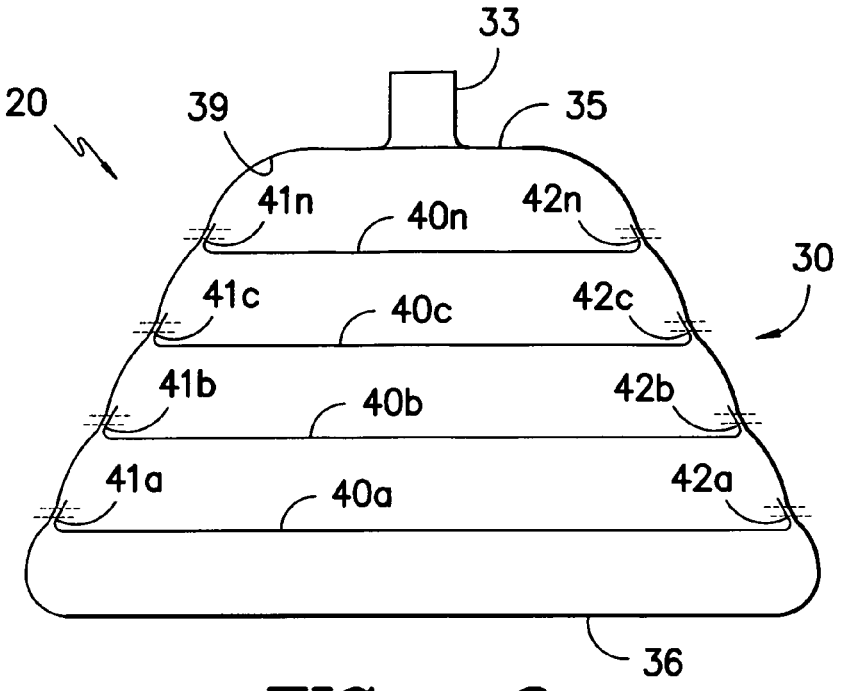
FIG. 3 is a cross-sectional view taken along the lines of 3-3 in FIG. 1.
Figure 4:
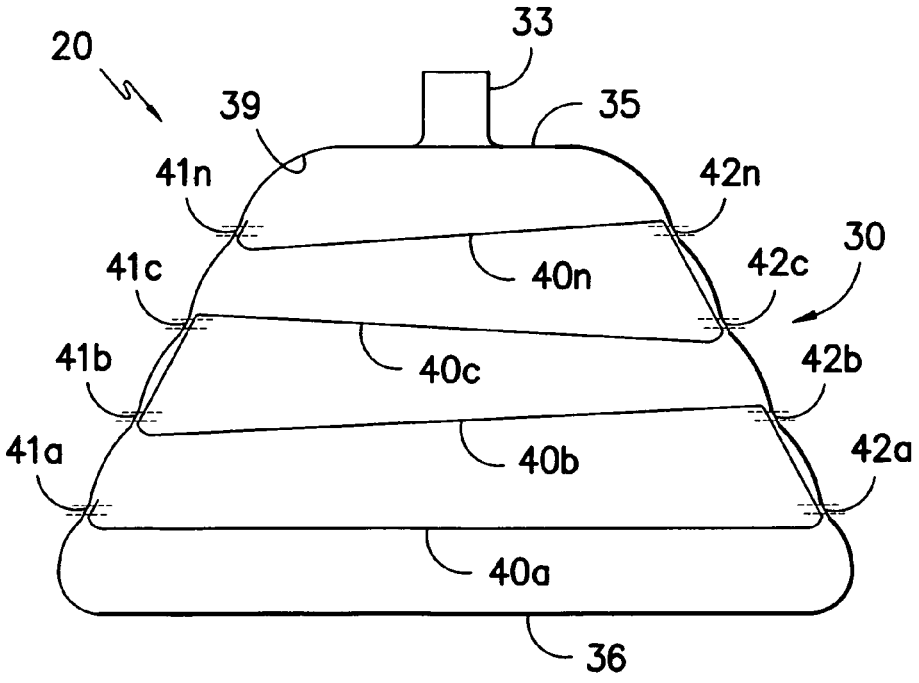
FIG. 4 is a cross-sectional view similar to the view of FIG. 3 but of an alternative embodiment.
Figure 5:
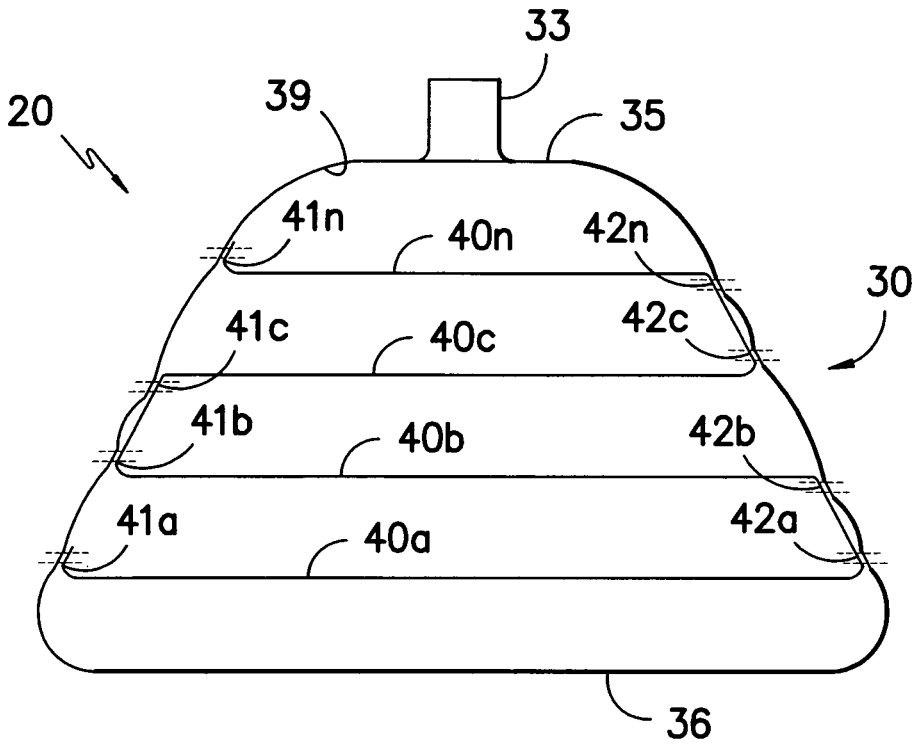
FIG. 5 is a cross-sectional view similar to the view of FIG. 3 but of another alternative embodiment.

As schematically shown in FIGS. 3, 5, 14 and 16 for example, the porous shelves 40*a*, 40*b*, 40*c*, 40*n* desirably are disposed parallel to each other. However, as schematically shown in FIGS. 4 and 15 for example, the shelves 40*a*, 40*b*, 40*c*, 40*n* also desirably can be disposed so that no two adjacent shelves 40 are disposed parallel to each other. As schematically shown in FIGS. 3 and 14 for example, each of the shelves 40*a*, 40*b*, 40*c*, 40*n* desirably can be formed of a separate sheet of porous web material. In alternative embodiments of the invention schematically shown in FIGS. 4, 5, 15 and 16 for example, the shelves 40*a*, 40*b*, 40*c*, 40*n* are formed by one continuous sheet of porous web material that snakes its way from near the bottom 36 to near the top 35 of the geotextile tube 30.

In embodiments such as those schematically depicted in FIGS. 1, 1A and 1B in which the geotextile tube 30 is formed by axially extending segments that are connected end-to-end to form the complete length of the geotube, the axial length of each porous shelf 40 can be limited to the axial length of the geotube segment in which the shelf is disposed. When the tube segments are joined together at their respective ends, the shelves also can be joined together in some embodiments, while in other embodiments the ends of the shelves can be left free of such attachment. Thus, in some of these embodiments, the axial ends of adjacent shelves in adjacent segments will be joined together. However, in other ones of these embodiments, the axial ends of adjacent shelves in adjacent segments will be left unattached to one another. In further ones of these embodiments, the axial ends of some of the adjacent shelves in adjacent segments can be joined together while the axial ends of other ones of the adjacent shelves in adjacent segments can be left unattached to one another.

Each porous shelf 40 desirably is defined by a porous web of material that includes open void over more than half the area of the web and desirably over more than up to 95% of the web. In some embodiments, at least one of the shelves 40 can include a web of geogrid material 50 in which the open area of the geogrid material 50 exceeds the solid area of the geogrid material 50 and is defined by a plurality of grid openings 53 that constitute up to at least 95% of the geogrid material 50 and render the geogrid material porous. The porous shelves 40 desirably can be formed of webs of geogrid material 50 that have relatively large grid openings 53 defined by transverse solid portions 51 and longitudinal solid portions 52.

Porous webs formed of geogrid material 50 are well known and come in many varieties of materials and configurations. Conventional geogrid materials 50 can be used and have high tensile strength and a uniform distribution of grid openings 53, both as to the size and shape of the grid openings 53. Conventional geogrid materials 50 are available in a variety of polymer types and cross-sectional dimensions and can be made in a variety of ways such as integrally made, bonded together by adhesives or bonded together ultrasonically, or joined in a knitting or weaving process and then coated with a polymer.

Figure 6:
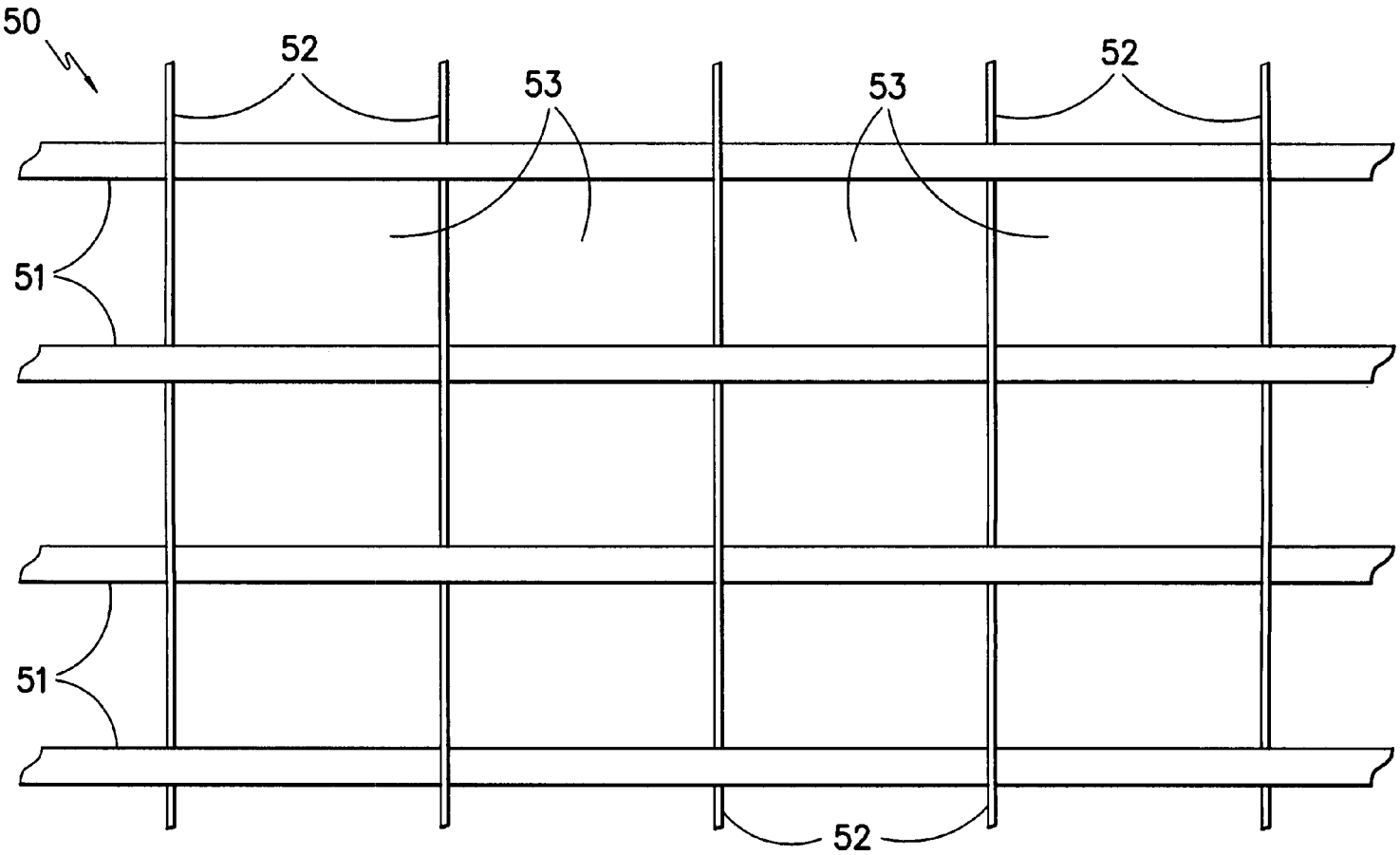
FIG. 6 is a top plan view of an embodiment of a component of a geotextile tube in accordance with the invention.

Some examples of webs formed of geogrid material 50 or parts thereof are depicted in FIGS. 6, 7, 8A, 8B and 8C. As shown in FIG. 6 for example, a web of geogrid 50 desirably includes solid portions 51, 52 that define grid openings 53. The areas of the grid openings 53 defined by the solid portions 51, 52 of the geogrid material 50 can vary. In one embodiment such as in FIG. 6, the areas of the grid openings 53 defined by the solid portions 51, 52 of the geogrid material 50 are uniform in magnitude. In another embodiment, the areas of the grid openings 53 defined by the solid portions 51, 52 of the geogrid material 50 are variable in magnitude. In an embodiment such as in FIG. 6, the shapes of the areas of the grid openings 53 defined by the solid portions 51, 52 of the geogrid material are uniform. In a further embodiment, there are various shapes of the areas of the grid openings 53 defined by the solid portions 51, 52 of the geogrid material. Moreover, though the shapes of the grid openings 53 depicted in FIG. 6 are rectangles, the shapes of the grid openings 53 can be any sort of polygon or curvature.

As shown schematically in FIGS. 1, 1A and 1B for example, the porous shelves 40 act to reinforce the warp yarns of the sheet of geotextile fabric 37 that forms the geotextile material that defines the geotextile tube 30 and that extend generally in the circumferential direction of the cylindrically shaped geotextile tube 30. As shown in FIG. 6 for example, the transverse solid portions 51 of the geogrid material 50 extending diametrically in the direction of the width of the shelf 40 are formed of a bundle of five strands of fiber, while the longitudinal solid portions 52 of the geogrid material 50 extending in the axial direction of the length of the shelf are formed of a single strand of fiber. Thus, as shown in FIG. 6 for example, the transverse solid portions 51 of the geogrid material 50 extending diametrically in the direction of the width of the shelf 40 desirably are stronger than the longitudinal solid portions 52 of the geogrid material 50 extending in the axial direction of the length of the shelf These differences in strength of the transverse solid portions 51 of the geogrid material 50 extending diametrically across the geotextile tube 30 in the direction of the width of the shelf also can be achieved with the same number of strands that are made of stronger material than the strands that form the longitudinal solid portions 52 of the geogrid material 50 extending in the axial direction of the length of the shelf and the geotextile tube 30.

Figure 7:
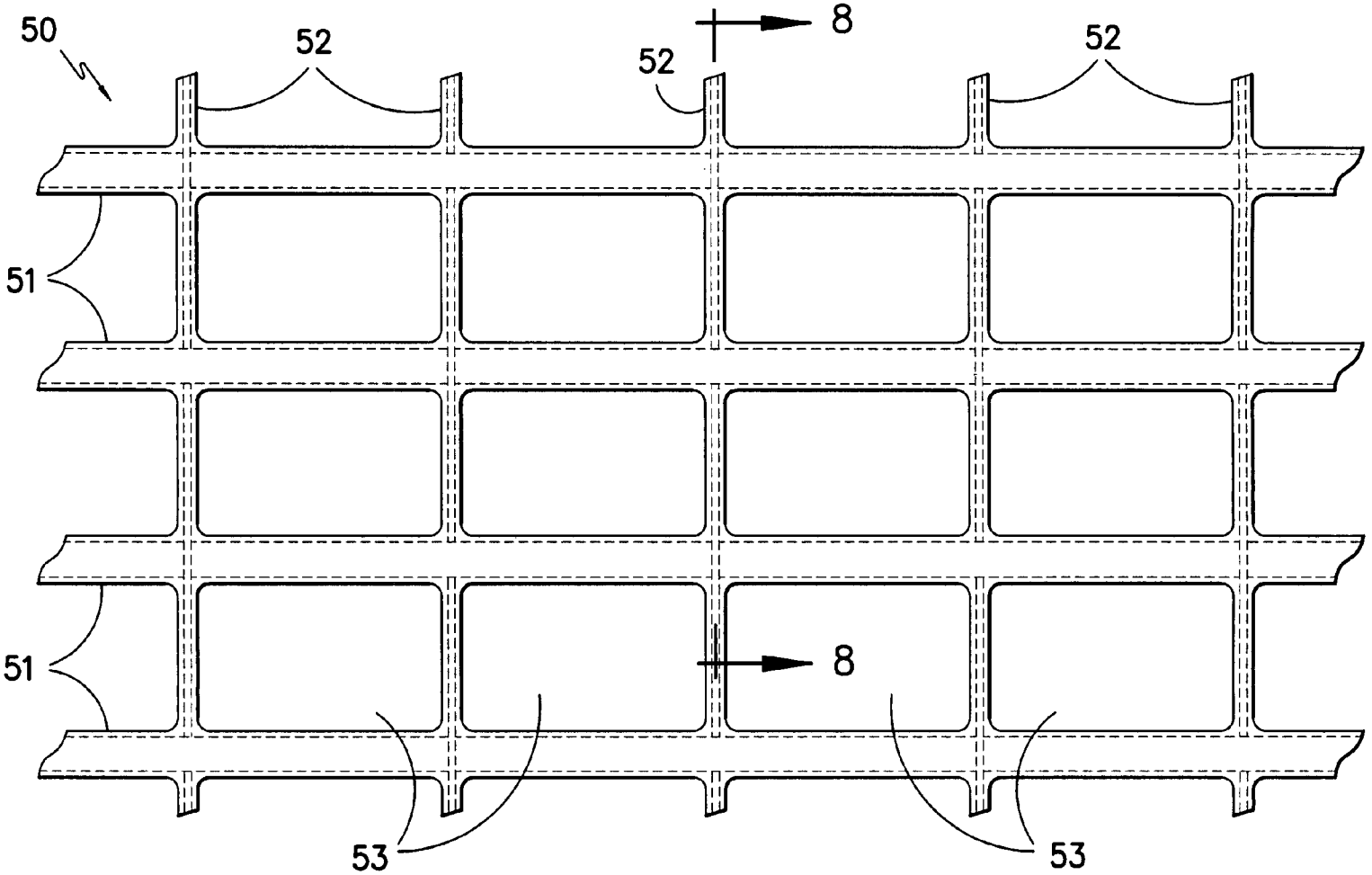
FIG. 7 is a top plan view of an embodiment of another component of a geotextile tube in accordance with the invention.
Figure 8A:
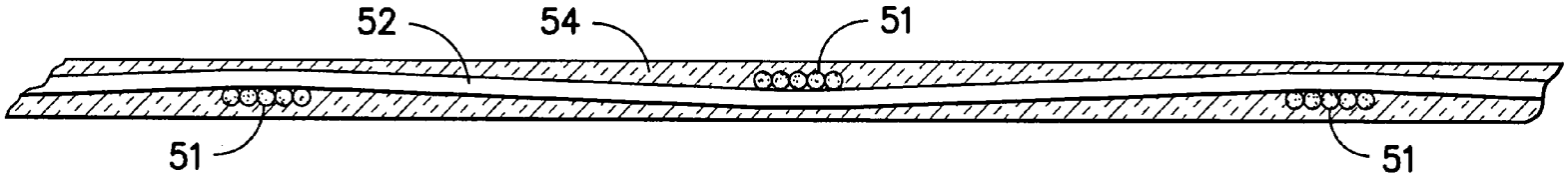
FIG. 8A is a cross-sectional view taken along the lines of 8-8 in FIG. 7 of an embodiment of a component of a geotextile tube in accordance with the invention.
Figure 8B:
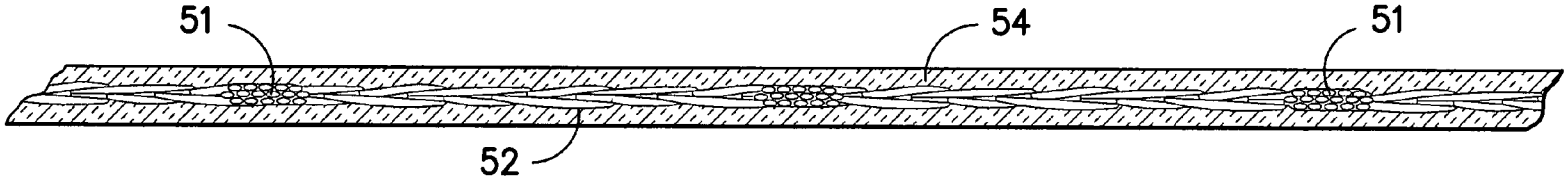
FIG. 8B is a cross-sectional view taken along the lines of 8-8 in FIG. 7 of another embodiment of a component of a geotextile tube in accordance with the invention.
Figure 8C:
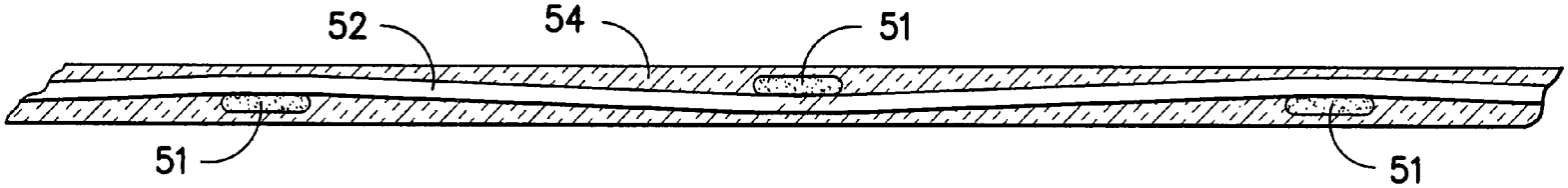
FIG. 8C is a cross-sectional view taken along the lines of 8-8 in FIG. 7 of a further embodiment of a component of a geotextile tube in accordance with the invention.

Another embodiment of geogrid material 50 is depicted in FIG. 7 for example. In the embodiments represented by FIG. 7, the geogrid material 50 has a coating 54 formed of a polymer such as polyester, polyethylene or polypropylene. FIGS. 8A, 8B and 8C schematically illustrate some of the different types of coated transverse solid portions 51 of the grid material 50 extending diametrically in the direction of the width of the shelf 40. In the embodiment of FIG. 8A for example, each of the transverse solid portions 51 of the grid material 50 extending diametrically in the direction of the width of the shelf 40 includes multiple strands of fiber embedded in a polymer coating 54 after being weaved with weft fiber strands 52. In the embodiment of FIG. 8B for example, each of the transverse solid portions 51 of the grid material 50 extending diametrically in the direction of the width of the shelf 40 includes multiple strands of fiber embedded in a polymer coating 54 after being knitted with fiber strands 52. In the embodiment of FIG. 8C for example, each of the transverse solid portions 51 of the grid material 50 extending diametrically in the direction of the width of the shelf 40 includes a single broad, flat strand of fiber embedded in a polymer coating 54 after being weaved with weft fiber strands 52.

Referring to FIG. 1 for example, as incompressible fill material is pumped through the inlet conduit 31 into the interior of the geotextile apparatus 20, the solids and/or liquids comprising the incompressible fill material pass successively through the grid openings 53 formed in each shelf 40*n*, 40*c*, 40*b*, 40*a* and eventually rest first on the bottom 36 of the geotextile tube 30. As the incompressible fill material continues to be pumped into the geotextile apparatus 20, the solids and/or liquids spread axially and transversely along the bottom 36 of the geotextile tube 30. The incompressible fill material (e.g., solids) also begins to fill the space above the bottom 36 of the geotextile tube 30 and the space above the first shelf 40*a* of the geotextile apparatus 20 and then the space above the second shelf 40*b* and then the space above each successive shelf 40*c*, 40*n*. As more and more of the solid fill material is pumped into the geotextile apparatus 20 and covers each successive shelf 40 and approaches closer to the top of the geotextile tube 30, the weight of the solid fill material tends to cause the solid fill material to spread outwardly in the direction of the width of the shelves and toward the sides of the geotextile tube 30.

Another function of the porous shelves 40 is to counteract the tendency of the solid fill material to shear and thus tend to spread outwardly in the direction of the width of the shelves 40 and against the axially extending opposite sides of the geotextile tube 30 where the weight of the fill material places stress on the geotextile fabric 37 forming the geotextile tube 30. The greater the degree of this sort of shear and resultant spreading, the greater are the strength requirements imposed on the geotextile fabric 37 that forms the geotextile tube 30, especially the fabric's yarns that extend circumferentially around the geotube 30. As shown in FIG. 1 for example, each of a plurality of the shelves 40 includes a web of geogrid material 50 defining a plurality of open areas 53. As shown in FIGS. 6 and 7 for example, this plurality of grid openings 53 of the geogrid material 50 is defined by the solid area 51, 52 of the geogrid material 50, and these solid portions 51, 52 of the geogrid material 50 forming the porous shelves 40 tend to inhibit the natural shearing tendency of the solid fill material. Desirably, the open areas 53 of successive shelves (e.g., 40*a*, 40*b*) are not aligned vertically with each other but are offset vertically from each other.

In some embodiments of the geotextile apparatus 20, the area of the grid openings 53 that define the geogrid material 50 of the nth shelf 40*n* would be larger than the area of the grid openings 53 that define the geogrid material 50 of the second shelf 40*b*. Arranging shelves 40*n* having relatively larger grid openings 53 nearest to the top 35 of the geotextile tube 30 facilitates filling of the geotextile tubes with incompressible fill material.

In some embodiments, the areas of the grid openings 53 defined by the solid portions 51, 52 of the geogrid material 50 forming the shelves 40 located closer to the bottom 36 of the geotextile tube 30 are smaller than the areas of the grid openings 53 defined by the geogrid material 50 forming the shelves 40 located farther from the bottom 36 of the geotextile tube 30. Arranging shelves 40*a*, 40*b*, 40*c* having relatively smaller grid openings 53 nearer to the bottom 36 of the geotextile tube 30 facilitates filling of the geotextile tubes with incompressible fill material to greater vertical heights above the bottom 36 by inhibiting the natural shearing tendency of the incompressible fill material. Geogrid material 50 with a larger number of geogrid openings 53 of smaller area tends to have a greater propensity to inhibit the shear effects of the incompressible fill material than geogrid material 50 having a smaller number of grid openings 53 of larger area, even though the total open area of each web of geogrid material 50 is the same. Thus, in the embodiment of FIG. 1 for example, the area of the grid openings 53 that define the geogrid material 50 of the first shelf 40*a* would be smaller than the area of the grid openings 53 that define the geogrid material 50 of the second shelf 40*b*. This arrangement places at the lower points within the interior of the geotextile tube 30, which is where the greater shear forces will develop as the geotextile tube 30 is filled with incompressible material, the geogrid material 50 having the greater propensity to inhibit shear. Thus, this shelf arrangement enhances the ability of the geotextile apparatus 20 to resist shear forces within the geotextile tube 30.

The shear force resistant capacity of the geotextile apparatus 20 enables the use of less expensive materials in constructing the geotextile tubes 30 for any given application. As one example, the geotextile apparatus 20 provides sufficient strength to the geotextile tube 30 so that the geotextile tube 30 can be formed of geotextile material that has sufficient strength to resist bursting under load when filled with materials that must be dewatered and yet is more porous than otherwise would be the case without the shelves 40 of geogrid material 50 and/or geocell material 60 (described below). Another advantage of the shear inhibiting properties of the geotextile apparatus 20 is the ability to construct geotextile tubes 30 that stand taller and remain stable for any given circumference of the geotextile tube 30 and any given quality of fill materials disposed in the interior of the geotextile tube 30. A further advantage of the shear inhibiting properties of the geotextile apparatus 20 is the ability to construct geotextile tubes 30 that can withstand significant loads riding on the top 35 of the geotextile tube 30 given a suitable quality of fill materials disposed in the interior of the geotextile tube 30. Yet another advantage of the shear inhibiting properties of the geotextile apparatus 20 is the ability to construct geotextile tubes 30 that can use a wider range of fill materials with different shear tendencies disposed in the interior of the geotextile tube 30.

In further embodiments such as shown in FIG. 1A, the shelves 40 desirably can be formed of one or more webs of geocell material 60. Examples of geocell material 60 are schematically shown in FIGS. 9 and 10. Webs formed of geocell material 60 are well known and come in many varieties of materials and configurations. Conventional geocell material 60 can be used and has high tensile strength and a uniform distribution of cell openings 62, both as to the size and shape of the cell openings 62. Conventional geocell material 60 is available in a variety of polymer types and cross-sectional dimensions and can be made in a variety of ways such as integrally made, bonded together by adhesives or ultrasonically bonded together.

As schematically shown in FIGS. 9 and 10 for example, geocell material 60 includes a plurality of interconnected, three-dimensional expandable panels 61 that are formed of high-density polyethylene (HDPE), polyester, or another polymer material. The panels 61 are the solid portions of the geocell material 60 that define the void areas of the cell openings 62 that can vary in size. As shown in one embodiment depicted in FIG. 9 for example, the walls of the panels 61 can be perforated with a plurality of pores 63 that permit communication between the individual cells of the geocell material 60. In one embodiment, the areas of the cell openings 62 defined by the solid portions 61 of the geocell material 60 forming the shelves 40 located closer to the bottom 36 of the geotextile tube 30 are smaller than the areas of the cell openings 62 defined by the geocell material 60 forming the shelves 40 located farther from the bottom 36 of the geotextile tube 30. In other embodiments such as shown in FIGS. 9 and 10, the areas of the cell openings 62 defined by the geocell material 60 forming each shelf 40 are uniform in magnitude. Desirably, as schematically shown in FIG. 1A for example, the open areas 62 of successive shelves (e.g., 40*a*, 40*b*) are not aligned vertically with each other but are offset vertically from each other.

In the embodiment shown in FIG. 1A, at least one of the shelves 40*a* includes a web of geocell material 60. As shown in FIGS. 9 and 10, the open area of the geocell material 60 very much exceeds the solid area 61 of the geocell material and is defined by a plurality of cell openings 62. As shown in FIG. 1A for example, each of a plurality of the shelves 40 includes a web of geocell material 60 in which the open area of the geocell material 60 very much exceeds the solid area of the geocell material 60 and is defined by a plurality of cell openings 62 that constitutes at least up to about 95% of the geocell material 60.

In some embodiments, the area of the cell openings 62 that define the geocell material 60 of the first shelf 40*a* is smaller than the area of the cell openings 62 that define the geocell material 60 of the second shelf 40*b*, and the width of the first shelf 40*a* is larger than the width of the second shelf 40*b*. Thus, in the embodiment of FIG. 1A for example, the area of the cell openings 62 that define the geocell material 60 of the first shelf 40*a* would be smaller than the area of the cell openings 62 that define the geocell material 60 of the second shelf 40*b*. This arrangement places at the lower points within the interior of the geotextile tube 30, which is where the greater shear forces will develop as the geotextile tube 30 is filled with incompressible material, the geocell material 60 having the greater propensity to inhibit shear. Thus, this shelf arrangement enhances the ability of the geotextile apparatus 20 to resist shear forces within the geotextile tube 30.

In some embodiments, the area of the cell openings 62 that define the geocell material 60 of the'nth shelf 40*n* is larger than the area of the cell openings 62 that define the geocell material 60 of the second shelf 40*b*, and the width of the nth shelf 40*a* is smaller than the width of the second shelf 40*b*. Arranging shelves 40*n* having relatively larger cell openings 62 nearest to the top 35 of the geotextile tube 30 facilitates filling of the geotextile tubes with incompressible fill material.

In the embodiment shown in FIG. 1B, at least one of the shelves 40*b* includes a web of geogrid material 50 that carries a web of geocell material 60. Thus, the web of geocell material 60 is disposed on a shelf 40*b* that includes the web of geogrid material 50. As shown in FIG. 1B, this same arrangement can be repeated for a plurality of shelves 40*b*, 40*d*, 40*f*, 40*h*. Similarly, some embodiments can include at least one shelf 40 formed by a web of geocell material 60 that carries a web of geogrid material 50, and this same arrangement can be repeated for a plurality of shelves 40.

In the embodiment shown in FIG. 1B, there are a plurality of shelves 40*b*, 40*d*, 40*f*, 40*h* that include a web of geogrid material 50 and a plurality of shelves 40*a*, 40*c*, 40*e*, 40*g*, 40*n* that include a web of geocell material 60. Moreover, the shelves 40*b*, 40*d*, 40*f*, 40*h* that include a web of geogrid material 50 alternate with one of the shelves 40*a*, 40*c*, 40*e*, 40*g*, 40*n* that include a web of geocell material 60. Any ordering of such shelves 40 is possible, and the number of each type of shelf 40, geogrid material 50 or geocell material 60, can be varied to suit the particular application of the geotextile apparatus 20. For example, the shelf 40 including a web of geogrid material 50 can be disposed closer to the top 35 of the geotextile tube 30 than any shelf 40 including a web of geocell material 60. Alternately, the shelf 40 including a web of geocell material 60 can be disposed closer to the top 35 of the geotextile tube 30 than any shelf 40 including a web of geogrid material 50. Moreover, as shown in FIG. 1B for example, a shelf 40 including a web of geocell material 60 can be disposed closer to the bottom 36 of the geotextile tube 30 than any shelf 40 including a web of geogrid material 50. However, it also is the case that a shelf 40 including a web of geogrid material 50 can be disposed closer to the bottom 36 of the geotextile tube 30 than any shelf 40 including a web of geocell material 60.

In some embodiments of the geotextile apparatus 20, there can be shelves 40 formed of geogrid material 50 and other shelves 40 formed of geocell material 60, and these two types of shelves 40 can be arranged in a manner that tends to inhibit shear forces within the type of fill material that is going to be used to fill the geotextile tube 30. Moreover, in addition to the type of fill material, the number of shelves 40 and the arrangement and type(s) of web used to form the shelves 40, the area of the individual openings 53, 62 that are formed through the shelves 40*a*, 40*b*, 40*c*, 40*n* and the total area of the openings 53, 62 relative to the solid area of each shelf 40 must be taken into account when selecting shelves 40 for the particular application that is intended for the geotextile apparatus 20.

Figure 2:
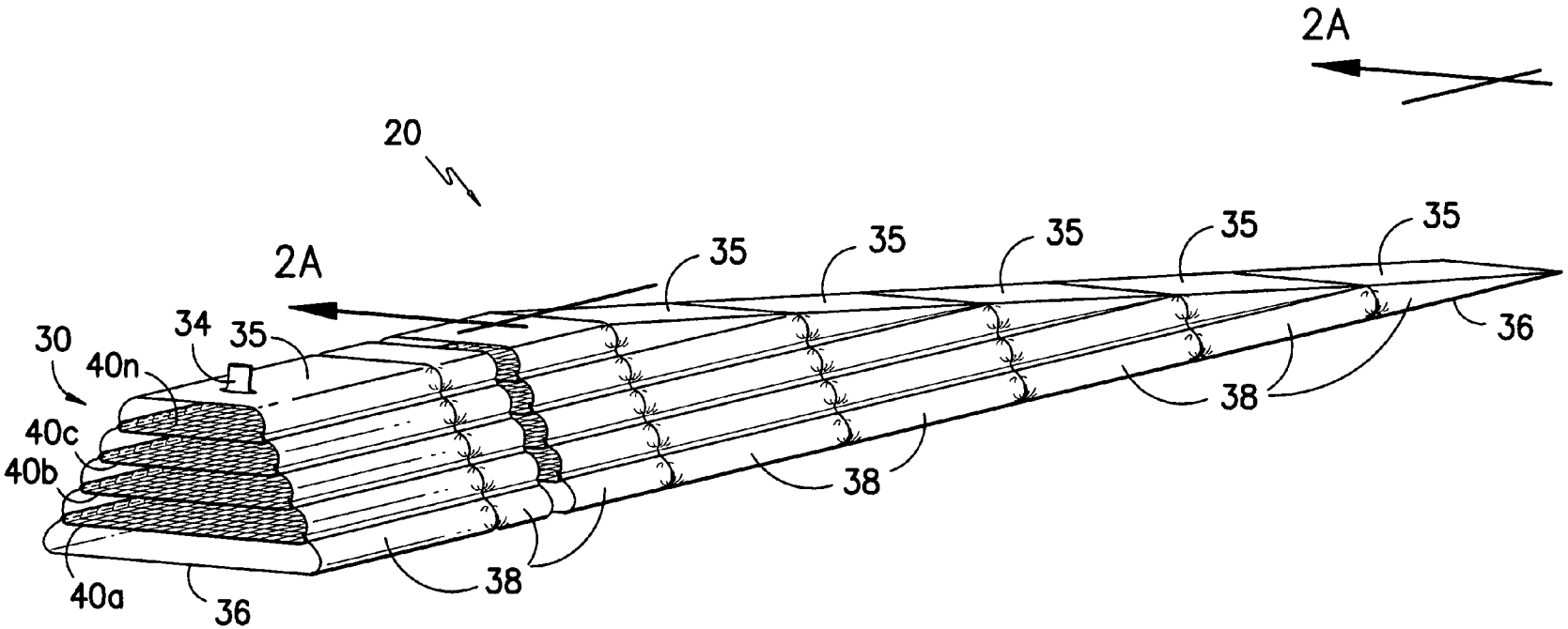
FIG. 2 is an elevated perspective view of a further embodiment of a geotextile tube in accordance with the invention with an open end and a middle section cut away for purposes of illustration of certain aspects of the geotextile tube.
Figure 2A:
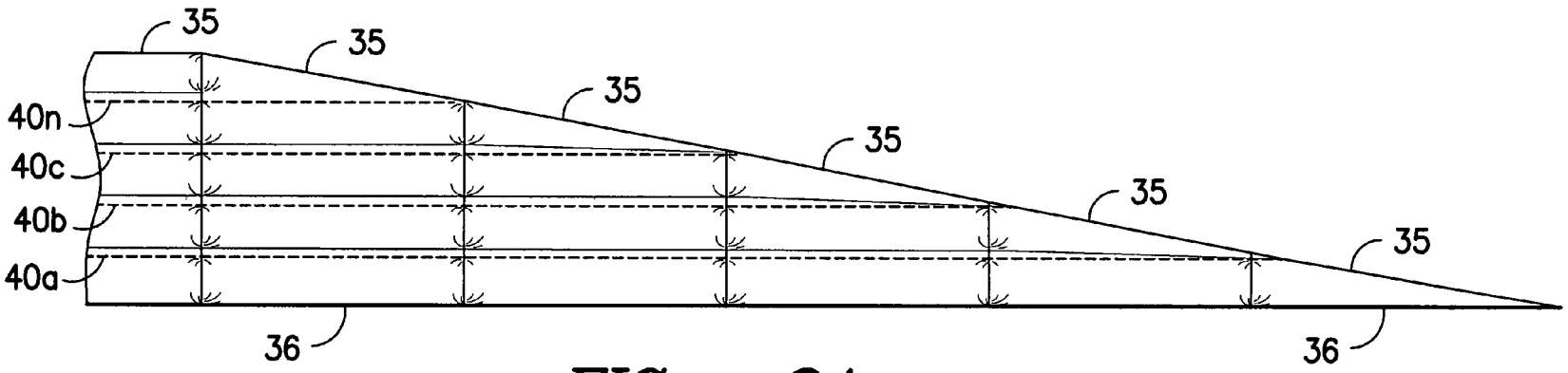
FIG. 2A is a cross-sectional view taken along the lines of 2A-2A in FIG. 1.
Figure 2B:
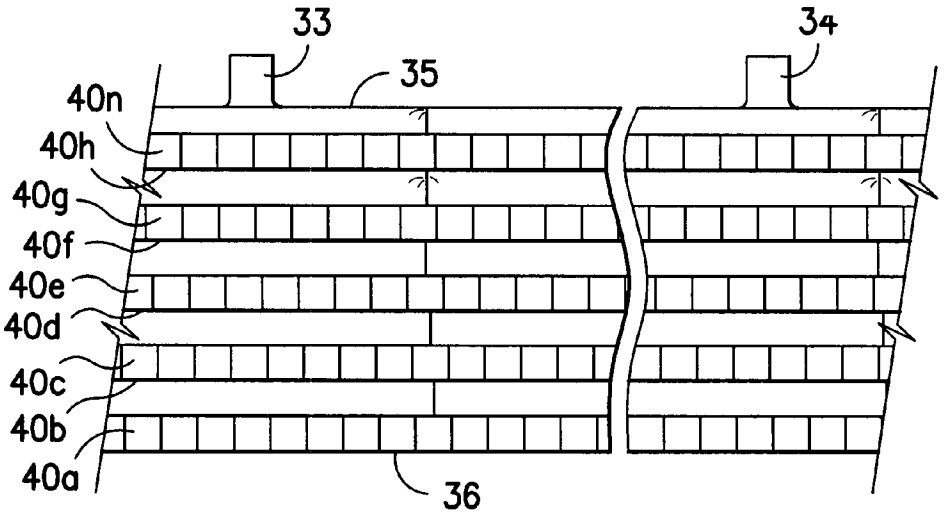
FIG. 2B is a cross-sectional view taken along the lines of 2B-2B in FIG. 1B.

In an alternative embodiment of the invention shown in FIGS. 2 and 2A, at least one end of the geotextile tube 30 defines a sloping profile. As schematically shown in FIG. 2A, each shelf 40 terminates axially in this sloping profile end of the geotextile tube 30 according to the relative order of its distance measured from the bottom 36 of the geotextile tube 30. Thus, the shelf 40*n* farthest from the bottom 36 of the geotextile tube 30 terminates axially before each of the other shelves 40*a*, 40*b*, 40*c* terminates axially, and the shelf 40*a* closest to the bottom of the geotextile tube 30 terminates axially after each of the other shelves 40*b*, 40*c*, 40*n* terminates axially.

Because of the shear inhibiting characteristics of the geotextile apparatus 20 of the present invention, the embodiment shown in FIGS. 2 and 2A is believed to be particularly suited to form a load bearing ramp that supports the travel of vehicles, at least on a temporary basis at a construction site for example.

In operation, the axially elongated geotextile tube 30 of the geotextile apparatus 20 of the present invention would be stretched out in position in the field with its bottom 36 resting on the underlying support surface and its inlet conduits 33 and outlet conduits 34 extending vertically upward into the air. If the geotextile apparatus 20 is to be deployed in a body of water, then hoses would be attached to the inlet conduits 33 and outlet conduits 34 before submerging the geotextile apparatus 20 in the water. At this point, the geotextile tube. 30 is essentially flattened and extending along the ground to its full length. If not already done so, then each of the inlet conduits 33 and outlet conduits 34 is connected to its own hose. Before pumping the final fill material into the geotube 30, it is desirable to pre-fill the geotube 30 by pumping either air or water into the geotube through the hoses attached to the inlet conduits 33 and the outlet conduits 34. As the geotube is thus pre-filled with air or water, the geotube 30 assumes the shape imposed by the shelves 40 as shown schematically in FIGS. 1, 1A, 1B and 3-5 for example. Next in the filling process, incompressible matter like solids or slurries of various materials in the immediate environment of the geotextile tube 30, depending on the application, are pumped into the geotextile tube 30 through the hoses attached to the inlet conduits 33. The fill material, which must be denser than the pre-fill material, passes through the grid openings 53 and/or cell openings 62 (as the case may be) in the shelf 40*n* nearest the top 35 of the geotube 30. Gravity pulls the fill material to find its way toward the bottom 36 of the geotextile tube 30 by passing through the grid openings 53 and/or cell openings 62 in the shelves 40 that are positioned beneath the uppermost shelf 40*n*. As the fill material settles by moving toward the bottom 35 of the geotextile tube 30, the pre-fill material is forced out of the outlet conduits 34. Thus, during this filling process, the pre-fill of air or water is expelled from the geotube 30 through the outlet conduits 34 while the overall shape of the geotube 30 is maintained. Eventually, the entire geotextile tube 30 is filled up with the desired amount of the incompressible fill material.

The presence of the shelves 40 tends to inhibit the shearing of the fill material at each level of shelf height of the fill material above the bottom of the geotube 30 and thereby enables the stable stacking of a higher amount of fill material inside the geotube 30 for any given shear characteristic of the fill material alone. Thus, the stable height of the geotextile apparatus 20 from the bottom 36 to the top 35 can be increased for any given type of fill material and geotextile tube 30 as compared to a conventional geotextile tube filled with the same fill material.

Viewed from the standpoint of inhibiting shear in the fill material, because shear is more likely in fill material that is disposed closer to the bottom 36 of the geotextile tube 30, as schematically shown in FIGS. 14-16 for example, the vertical distance between successive shelves 40*a*, 40*b*, 40*c* disposed closer to the bottom 36 of the geotextile tube 30 desirably is smaller than the vertical distance between the shelves 40 disposed closer to the top 35 of the geotextile tube 30. For example, near the bottom of the geotextile tube 30, this arrangement schematically shown in FIGS. 14-16 for example, places a relatively greater number of geogrid shelves 40 per unit of height of the fill material above the bottom 36 of the geotextile tube 30. From the standpoint of minimizing the cost of the geotextile apparatus 20 while maximizing the shear inhibiting capacity of the geotextile apparatus 20, for any given number of shelves 40*a*-40*n* disposed within the geotextile tube 30, the density of shelves 40 should be greater near the bottom 36 of the geotextile tube 30 and less toward the top 35 of the geotextile tube 30. Moreover, because a shelf 40 formed of geocell material 60 has a greater capacity to inhibit shear than a shelf 40 formed of geogrid material 50 where the openings 53 and 62 are the same in number and area in each shelf 40 and because the geocell material 60 will be more costly than the geogrid material 50 under these specifications, the shelves 40*a*, 40*b*, 40*c* formed of geocell material 60 desirably should be disposed closer to the bottom 36 of the geotextile tube 30. Additionally, because geogrid material 50 and geocell material 60 with a relatively greater number of relatively smaller openings 53 or 62 has a greater ability to inhibit shear of the fill material but tends to cost more than geogrid material 50 and geocell material 60 with a relatively smaller number of relatively larger openings 53 or 62, the shelves 40*a*, 40*b*, 40*c* disposed closer to the bottom 36 of the geotextile tube 30 desirably should have a relatively larger number of relatively smaller openings (53 or 62 as the case may be) whether these shelves are formed of geogrid material 50 or geocell material 60.

Figure 11:
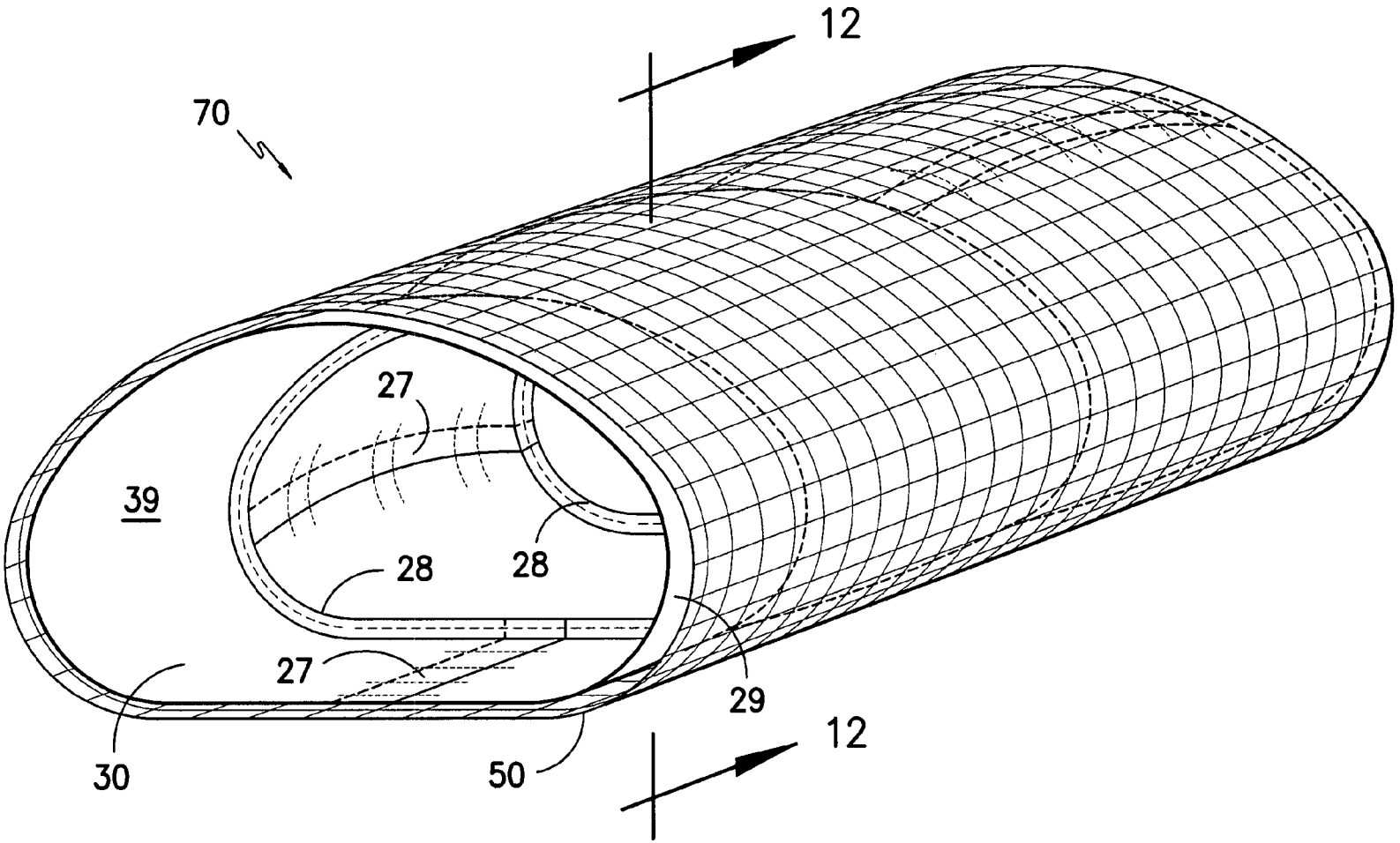
FIG. 11 is a an elevated perspective view of embodiments of components of a partially constructed geotextile tube in accordance with an alternative embodiment of the invention with an open end shown for purposes of illustration of certain aspects of the geotextile tube.
Figure 12:
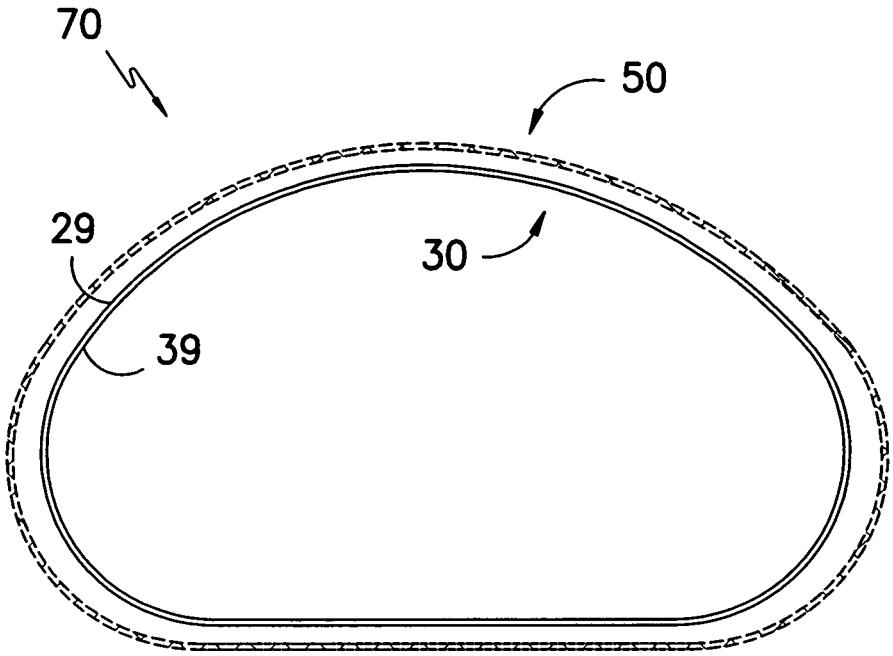
FIG. 12 is a cross-sectional view taken along the lines of 12-12 in FIG. 11 or FIG. 13.
Figure 13:
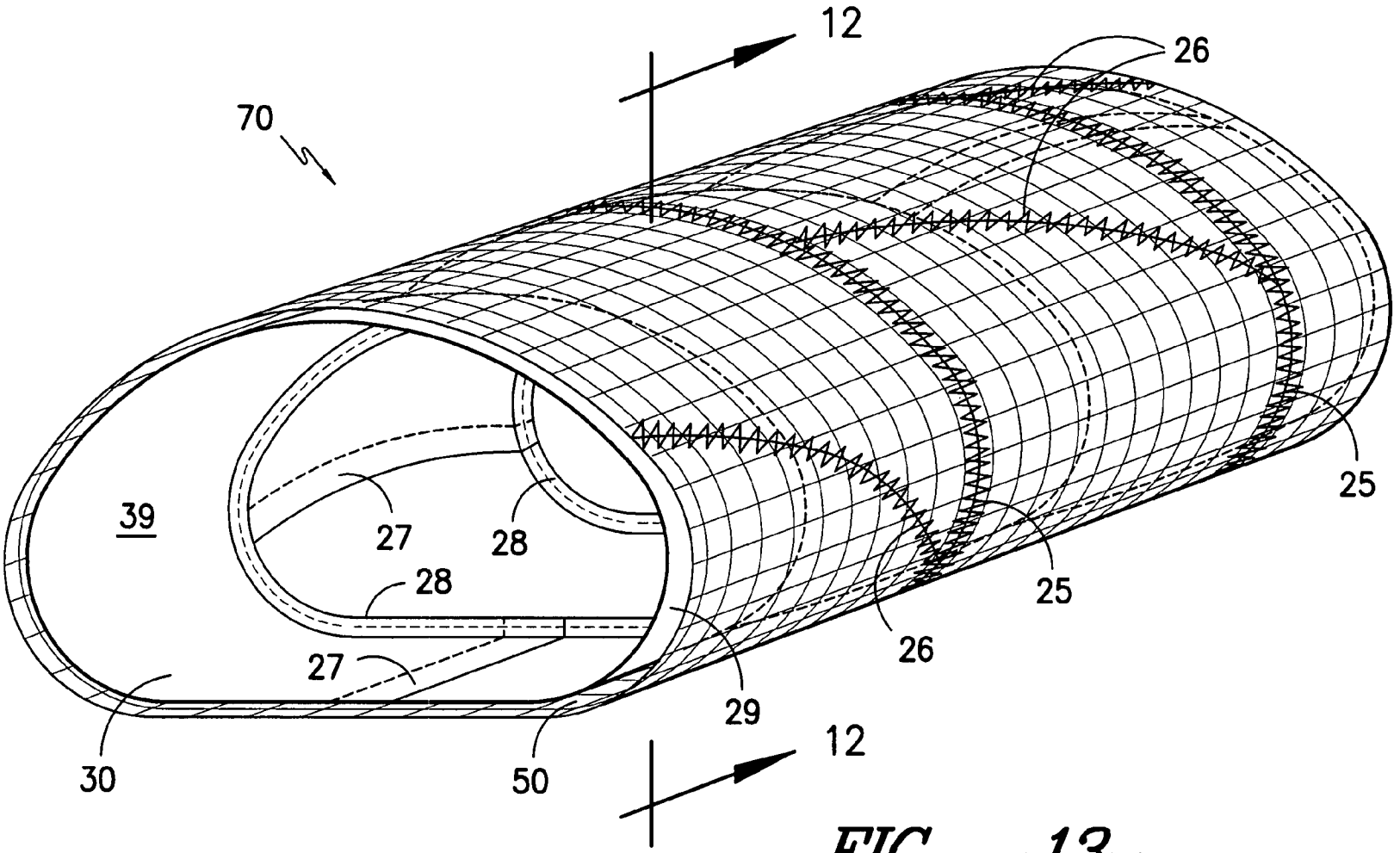
FIG. 13 is a an elevated perspective view of other embodiments of components of a partially constructed geotextile tube in accordance with alternative embodiments of the invention with an open end shown for purposes of illustration of certain aspects of the geotextile tube.

Another embodiment of the invention includes an axially elongated geotextile tube 30 that is wrapped within an envelope of geogrid material 50. As shown in FIGS. 11-13 for example, a geotextile apparatus 70 comprises an axially elongated geotextile tube 30 formed of geotextile fabric and having a circumference of at least six meters. The geotextile tube 30 defines an interior surface 39 and an exterior surface 29 opposite the interior surface 39. The interior surface 39 defines a hollow interior of the tube 30. The geotextile apparatus 70 further comprises an envelope formed of geogrid material 50. The envelope of geogrid material 50 surrounds the exterior surface 29 of the geotextile tube 30. The envelope of geogrid material 50 forming the outer envelope of the geotextile apparatus 70 provides added reinforcement to the geotextile tube 30 so that the geotextile tube 30 can be formed of geotextile material that is more porous than otherwise would be the case without the envelope of geogrid material 50 and yet the geogrid material 50 enables the geotextile tube 30 to resist bursting under load when filled with materials that must be dewatered.

The geotextile tube 30 shown in FIGS. 11-13 is a so-called segmented geotextile tube 30 constructed of a series of cylindrical segments of geotextile material connected end-to-end by circumferentially extending seams 28. In the embodiment of FIGS. 11 and 13 for example, each cylindrical segment of geotextile material 37 is formed by an axially extending seam 27. However, other types of geotextile tubes 30 can be used in this embodiment of the geotextile apparatus 70. Moreover, as schematically shown in FIG. 13 for example, the envelope of geogrid material 50 forming the outer envelope of the geotextile apparatus 70 can itself desirably be provided with reinforcing ribs 25, 26 formed therein. The circumferential reinforcing ribs 25 extend circumferentially around the envelope of geogrid material 50 of the geotextile apparatus 70 and desirably can take the form of reinforcing stitching, with or without a strip of additional material such as geotextile material or geogrid material of the same type or different type. Similarly, the spiral reinforcing ribs 26 extend spirally around the envelope of geogrid material 50 of the geotextile apparatus 70 and desirably can take the form of reinforcing stitching, with or without a strip of additional material such as geotextile material or geogrid material of the same type or different type. Though not shown in FIGS. 11-13, the geotextile apparatus 70 also can be provided with a plurality of internal shelves 40 as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A geotextile apparatus, comprising:

a. an axially elongated tube having a circumference of at least six meters and defining an interior surface that defines a hollow interior of the tube, which is water permeable but retains solids;

b. a first generally planar, porous shelf disposed within the interior of the tube and having a length extending axially down the length of the tube, the first shelf defining a first elongated side edge connected to the interior surface of the tube and a second elongated side edge disposed opposite the first side edge and connected to the interior surface of the tube, the distance between the first and second side edges defining the width of the first shelf extending across the interior of the tube, the majority of the entire axial length of each of the first side edge and the second side edge of the first shelf being substantially continuously connected in contact with the interior surface of the tube;

c. a second generally planar, porous shelf disposed above and spaced apart from the first shelf within the interior of the tube and having a length extending axially down the length of the tube, the second shelf defining a first elongated side edge connected to the interior surface of the tube and a second elongated side edge disposed opposite the first side edge and connected to the interior surface of the tube, the distance between the first and second side edges defining the width of the second shelf extending across the interior of the tube, the majority of the entire axial length of each of the first side edge and the second side edge of the second shelf being substantially continuously connected in contact with the interior surface of the tube; and d. at least a third generally planar, porous shelf disposed above and spaced apart from the second shelf within the interior of the tube and having a length extending axially down the length of the tube, the third shelf defining a first elongated side edge connected to the interior surface of the tube and a second elongated side edge disposed opposite the first side edge and connected to the interior surface of the tube, the distance between the first and second side edges defining the width of the third shelf extending across the interior of the tube, the majority of the entire axial length of each of the first side edge and the second side edge of the second shelf being substantially continuously connected in contact with the interior surface of the tube.

2. The geotextile apparatus of claim 1, wherein the width of each successive shelf decreases from the first shelf to the third shelf.

3. The geotextile apparatus of claim 1, wherein at least one of the shelves includes a web of geogrid material disposed substantially horizontally within the interior of the tube and in which the open area of the geogrid material exceeds the solid area of the geogrid material and the open area of the geogrid material is defined by a plurality of grid openings.

4. The geotextile apparatus of claim 1, wherein each of a plurality of the shelves includes a web of geogrid material in which the open area of the geogrid material exceeds the solid area of the geogrid material and the open area of the geogrid material is defined by a plurality of grid openings.

5. The geotextile apparatus of claim 4, wherein the plurality of the shelves includes the first shelf and the third shelf, and the area of the grid openings that are defined by the geogrid material of the first shelf is smaller than the area of the grid openings that are defined by the geogrid material of the third shelf.

6. The geotextile apparatus of claim 4, wherein the width of the first shelf is larger than the width of the second shelf.

7. The geotextile apparatus of claim 4, wherein the width of the third shelf is smaller than the width of the second shelf.

8. The geotextile apparatus of claim 4, wherein the plurality of the shelves includes the second shelf and the third shelf, and the area of the grid openings that define the geogrid material of the third shelf is larger than the area of the grid openings that define the geogrid material of the second shelf.

9. The geotextile apparatus of claim 4, wherein the plurality of the shelves includes the first shelf, the second shelf, the third shelf and the shelf closest to the third shelf, and the vertical distance between the first shelf and the second shelf is smaller than the vertical distance between the third shelf and the shelf closest to the third shelf.

10. The geotextile apparatus of claim 1, wherein at least one of the shelves includes a web of geocell material in which the open area of the geocell material exceeds the solid area of the geocell material and is defined by a plurality of cell openings.

11. The geotextile apparatus of claim 10, wherein the shelf closest to the bottom of the geotextile tube includes a web of geocell material.

12. The geotextile apparatus of claim 10, further comprising a web of geogrid material in which the open area of the geogrid material exceeds the solid area of the geogrid material and is defined by a plurality of grid openings, the web of geogrid material being disposed on the shelf that includes the web of geocell material.

13. The geotextile apparatus of claim 1, wherein each of a plurality of the shelves includes a web of geocell material in which the open area of the geocell material exceeds the solid area of the geocell material and the open area of the geocell material is defined by a plurality of cell openings.

14. The geotextile apparatus of claim 13, wherein the plurality of the shelves includes the first shelf and the third shelf, and the area of the cell openings that are defined by the geocell material of the first shelf is smaller than the area of the cell openings that are defined by the geocell material of the third shelf.

15. The geotextile apparatus of claim 13, wherein the width of the first shelf is larger than the width of the second shelf.

16. The geotextile apparatus of claim 13, wherein the width of the third shelf is smaller than the width of the second shelf.

17. The geotextile apparatus of claim 13, wherein the plurality of the shelves includes the second shelf and the third shelf, and the area of the cell openings that are defined by the geocell material of the third shelf is larger than the area of the cell openings that are defined by the geocell material of the second shelf.

18. The geotextile apparatus of claim 13, wherein the plurality of the shelves includes the first shelf, the second shelf, the third shelf and the shelf closest to the third shelf, and the vertical distance between the first shelf and the second shelf is smaller than the vertical distance between the third shelf and the shelf closest to the third shelf.

19. The geotextile apparatus of claim 1, wherein: the geotextile tube defines a top and a bottom disposed opposite the top and configured to rest on the surface that underlies and supports the tube when the geotextile apparatus is deployed for an intended use of the geotextile apparatus, at least a first one of the shelves includes a web of geogrid material in which the open area of the geogrid material exceeds the solid area of the geogrid material and is defined by a plurality of grid openings, and at least a second one of the shelves includes a web of geocell material in which the open area of the geocell material exceeds the solid area of the geocell material and is defined by a plurality of cell openings.

20. The geotextile apparatus of claim 19, wherein the shelf including the web of geogrid material is disposed closer to the top of the geotextile tube than the shelf including the web of geocell material.

21. The geotextile apparatus of claim 20, wherein the shelf including the web of geocell material is disposed closer to the top of the geotextile tube than the shelf including the web of geogrid material.

22. The geotextile apparatus of claim 1, wherein the tube includes an axially elongated envelope comprising geotextile fabric.

23. The geotextile apparatus of claim 1, wherein the shelves are disposed so that no two adjacent shelves are parallel to each other.

24. The geotextile apparatus of claim 1, wherein the geotextile tube defines a top and a bottom disposed opposite the top and configured to rest on the surface that underlies and supports the tube when the geotextile apparatus is deployed for an intended use of the geotextile apparatus, the geotextile apparatus further comprising at least one inlet opening and at least one outlet opening formed through the top of the geotextile tube, a respective inlet conduit and outlet conduit extending through each such opening, wherein the shelves are formed by one continuous sheet of web material that snakes its way from near the bottom to near the top of the geotextile tube.

25. The geotextile apparatus of claim 1, further comprising an envelope formed of geogrid material, the envelope surrounding the entire exterior circumferential surface of the geotextile tube, which is wrapped within the envelope of geogrid material.

26. The geotextile apparatus of claim 1, wherein the axial dimension of the tube is the relatively longer dimension of the tube and the elongated tube defines sides that extend in the axial dimension of the tube and wherein the elongated tube defines a pair of opposed ends, each end extending transversely with respect to the sides and along the relatively shorter dimension of the tube, wherein at least one end of the geotextile tube defines a sloping profile, wherein in the sloping profile end of the geotextile tube the shelf farthest from the bottom of the geotextile tube terminates axially before each of the other shelves terminates axially, and the shelf closest to the bottom of the geotextile tube terminates axially after each of the other shelves terminates axially.

27. The geotextile apparatus of claim 1, wherein the third generally planar, porous shelf includes a web of geocell material in which the open area of the geocell material exceeds the solid area of the geocell material and the open area of the geocell material is defined by a plurality of cell openings.

* * * * *